US009962944B2

(12) United States Patent
Kanegae

(10) Patent No.: US 9,962,944 B2
(45) **Date of Patent: *May 8, 2018**

(54) LIQUID EJECTING HEAD, FLOW PATH MEMBER THEREFOR, PRODUCTION METHOD THEREFOR, AND LIQUID EJECTING APPARATUS

(71) Applicant: SEIKO EPSON CORPORATION, Tokyo (JP)

(72) Inventor: Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

This patent is subject to a terminal disclaimer.

(21) Appl. No.: 15/137,663

(22) Filed: Apr. 25, 2016

(65) Prior Publication Data

US 2016/0332443 A1 Nov. 17, 2016

(30) Foreign Application Priority Data

May 15, 2015 (JP) ..... 2015-100440

(51) Int. Cl.
*B41J 2/175* (2006.01)

(52) U.S. Cl.
CPC ..... *B41J 2/175* (2013.01); *B41J 2202/19* (2013.01)

(58) Field of Classification Search
CPC .... B41J 2/175; B41J 2/17503; B41J 2/17513; B41J 2/17523; B41J 2202/19
See application file for complete search history.

(56) References Cited

U.S. PATENT DOCUMENTS 6,634,742 B2 10/2003 Owaki et al.
6,698,454 B2 3/2004 Sjolander et al.
8,419,173 B2 * 4/2013 Hayashi ..... B41J 2/175 347/31
9,067,424 B1 6/2015 Tominaga et al.
9,340,020 B2 * 5/2016 Kanegae ..... B41J 2/1433
(Continued)

FOREIGN PATENT DOCUMENTS

JP 2003305873 A 10/2003
JP 2006-218670 8/2006
(Continued)

*Primary Examiner* — Julian Huffman
*Assistant Examiner* — Michael Konczal
(74) *Attorney, Agent, or Firm* — Workman Nydegger

(57) ABSTRACT

A liquid ejecting head includes a second flow-path-member comprising a second flow-path in communication with first and third flow-paths provided in first and second flow-path-members, the second flow-path-member stacked with the third flow-path-members in a stacking direction. A boundary between the first and second flow-path is tightly sealed by a first sealing-member. A boundary between the second and third flow-path is tightly sealed by a second sealing-member. The second flow-path-member includes a first substrate for positioning itself to the third flow-path-member in first and second directions intersecting with the stacking direction, and a second substrate for positioning itself to the third flow-path-member in the stacking direction. The first substrate is pressed against in the first and second directions by one of the first and second sealing-member. The second substrate is pressed against in the stacking direction by another one of the first and second sealing-member.

19 Claims, 14 Drawing Sheets

(56) References Cited

U.S. PATENT DOCUMENTS

| | | | | |
|---|---|---|---|---|
| 2003/0151645 | A1 | 8/2003 | Yamada et al. | |
| 2005/0050623 | A1 | 3/2005 | Greene | |
| 2008/0043059 | A1 | 2/2008 | Okazawa et al. | |
| 2010/0214379 | A1 | 8/2010 | Owaki et al. | |
| 2012/0182363 | A1* | 7/2012 | Watanabe ..... | B41J 2/175<br>347/85 |
| 2014/0375727 | A1 | 12/2014 | Kanegae | |

FOREIGN PATENT DOCUMENTS

| | | | |
|---|---|---|---|
| JP | 2009006730 | A | 1/2009 |
| JP | 2012-126062 | | 7/2012 |
| JP | 2015-003421 | | 1/2015 |

* cited by examiner

LIQUID EJECTING HEAD, FLOW PATH MEMBER THEREFOR, PRODUCTION METHOD THEREFOR, AND LIQUID EJECTING APPARATUS

CROSS-REFERENCE TO RELATED APPLICATIONS

This application claims priority to Japanese Patent Application No. 2015-100440 filed on May 15, 2015. The entire disclosures of Japanese Patent Application No. 2015-100440 is hereby incorporated herein by reference.

BACKGROUND

1. Technical Field

The present invention relates to a liquid ejecting head that ejects a liquid from a nozzle, a flow path member for the liquid ejecting head, a production method for the liquid ejecting head, and a liquid ejecting apparatus. Particularly, the invention relates to an ink jet recording head that ejects an ink as a liquid, a flow path member therefor, a production method therefor, and an ink jet recording apparatus.

2. Related Art

A representative example of liquid ejecting heads that eject liquids is an ink jet recording head that ejects ink drops. A proposed ink jet recording head includes a head body that ejects ink drops from nozzles and a flow path member that is fixed to the head body and that supplies the head body with an ink from a liquid storage unit, such as an ink cartridge, in which the ink is stored (see, e.g., JP-A-2015-003421).

A flow path member that constitutes the above-described ink jet recording head is, for example, formed by a second flow path member and a third flow path member that are stacked, and a connecting portion (i.e. a boundary) between flow paths of the second flow path member and of the third flow path member are tightly sealed by pressing a first sealing member against the connecting portion in a stacking direction in which the two flow path members are stacked. On another hand, a connecting portion between flow paths of the second flow path member and of the liquid storage unit, which forms a first flow path member, is tightly sealed by pressing a second sealing member against the connecting portion in a first direction and a second direction that intersect with the stacking direction.

However, in the case where the second flow path member is connected to the third flow path member by pressing the first sealing member in the stacking direction and is connected to the first flow path member, which includes the liquid storage unit or the like, by pressing the second sealing member in the first direction and the second direction, there is a problem that if there occurs a variation in the dimensions of various portions that constitute the flow path members, a positional deviation occurs in the connecting portion between flow paths so that ink leaks.

Furthermore, in the case where the second flow path member is constructed by stacking a plurality of members in order to form complicated flow paths in the second flow path member, there is a risk that errors, such as dimensional variations of the stacked members at the time of production and positional deviations at the time of stacking, will result in a positional deviation of a portion where flow paths are connected.

This problem is not confined to the ink jet recording heads but also occurs similarly in liquid ejecting heads that eject liquids other than ink.

SUMMARY

An advantage of some aspects of the invention is that a liquid ejecting head, a production method for the liquid ejecting head, and a liquid ejecting apparatus in which the tight sealing of the connecting portions between flow paths is accomplished securely so that leakage of liquid is substantially prevented are provided.

According to a first aspect of the invention, a liquid ejecting head includes a second flow path member that has a second flow path that communicates with a first flow path that is provided in a first flow path member, a third flow path member which has a third flow path that communicates with the second flow path provided in the second flow path member and which is stacked with the second flow path member, and a nozzle that ejects a liquid supplied via the first flow path, the second flow path, and the third flow path. A connecting portion between the first flow path and the second flow path is tightly sealed by a first sealing member. A connecting portion between the second flow path and the third flow path is tightly sealed by a second sealing member. The second flow path member includes a first substrate that carries out positioning relative to the third flow path member in a first direction and a second direction that intersect with a stacking direction of the second flow path member and a second substrate that carries out positioning relative to the third flow path member in the stacking direction of the second flow path member. The first substrate is pressed against in the first direction and the second direction by one of the first sealing member and the second sealing member. The second substrate is pressed against in the stacking direction by another one of the first sealing member and the second sealing member. Or a liquid ejecting head includes a second flow path member that has a second flow path in communication with a first and a third flow paths provided in a first flow path member and a third flow path member, the second flow path member stacked with the third flow path members in a stacking direction; and a nozzle configured to eject a liquid supplied via the first flow path, the second flow path, and the third flow path, wherein a boundary between the first flow path and the second flow path is tightly sealed by a first sealing member, and wherein a boundary between the second flow path and the third flow path is tightly sealed by a second sealing member, and wherein the second flow path member includes a first substrate for positioning itself to the third flow path member in a first direction and a second direction intersecting with the stacking direction, and a second substrate for positioning itself to the third flow path member in the stacking direction, and wherein the first substrate is pressed against in the first direction and the second direction by one of the first sealing member and the second sealing member, and wherein the second substrate is pressed against in the stacking direction by another one of the first sealing member and the second sealing member.

In this aspect, by positioning the first substrate of the second flow path member in the first direction and the second direction, the amounts of press of one of the first sealing member and the second sealing member in the first direction and the second direction can be appropriately adjusted. Furthermore, by positioning the second substrate of the second flow path member in the stacking direction, the amount of press of the other one of the first sealing member and the second sealing member in the stacking direction can be appropriately adjusted.

In the foregoing liquid ejecting head, the second flow path member may be fixed to the third flow path member by a screw that is screwed to a screw hole that is provided in the third flow path member, and the screw hole may be provided more to a second flow path side in the stacking direction than is the connecting portion between the second flow path and the third flow path. The thus-configured liquid ejecting head makes it easy to secure a space for the screw holes and therefore achieve a size reduction.

In the foregoing liquid ejecting head, the second flow path member may have a filter between the first substrate and the second substrate. According to the thus-configured liquid ejecting head, a complicated flow path that includes a filter can be easily formed.

In any one of the foregoing liquid ejecting heads, the third flow path member may include a positioning pin that is used for the positioning in the first direction and the second direction and a first positioning surface that is used for the positioning in the stacking direction. The first substrate may include a positioning hole that contacts the positioning pin of the third flow path member in the first direction and the second direction. The second substrate may include a second positioning surface that contacts the first positioning surface of the third flow path member in the stacking direction. According to the thus-configured liquid ejecting head, the positioning pin and the positioning hole allow the highly accurate positioning in the first direction and the second direction, and the first positioning surface and the second positioning surface allow the highly accurate positioning in the stacking direction.

In the foregoing liquid ejecting head, the second substrate may include an exposure hole that exposes the positioning hole of the first substrate when viewed in the stacking direction from a proximal end side of the positioning pin to a distal end side of the positioning pin. According to the thus-configured liquid ejecting head, the provision of the exposure hole makes it possible to substantially prevent the second substrate from contacting the positioning pin and therefore impeding the positioning.

In any one of the foregoing liquid ejecting heads, one of the first substrate and the second substrate may include a substrate-positioning pin that carries out positioning of the first substrate and the second substrate relative to each other in the first direction and the second direction and another one of the first substrate and the second substrate may include a substrate-positioning hole that contacts the substrate-positioning pin in the first direction and the second direction. According to the thus-configured liquid ejecting head, the first substrate and the second substrate can be positioned relative to each other in the first direction and the second direction. Furthermore, since the first substrate and the second substrate can relatively position each other, the stacking of the second flow path member on the first flow path member or the third flow path member can be performed after the first substrate and the second substrate of the second flow path member are assembled.

In any one of the foregoing liquid ejecting heads, the first substrate and the second substrate may be provided with the second flow path.

Any one of the foregoing liquid ejecting heads may further include the first sealing member and the second sealing member.

According a second aspect of the invention, a liquid ejecting apparatus includes any one of the foregoing liquid ejecting heads. The second aspect of the invention realizes a liquid ejecting apparatus that substantially prevents leakage of ink.

According to a third aspect of the invention, a flow path member provides communication between a first flow path provided in a first flow path member and a third flow path provided in a third flow path member by using a first sealing member and a second sealing member, is stacked with the third flow path member in a stacking direction, and includes a first substrate that carries out positioning relative to the third flow path member in a first direction and a second direction that intersect with the stacking direction, a second substrate that carries out positioning relative to the third flow path member in the stacking direction, and a second flow path that communicates with the first flow path in a state of being tightly sealed by the first sealing member and that communicates with the third flow path in a state of being tightly sealed by the second sealing member. The first substrate is pressed against in the first direction and the second direction by one of the first sealing member and the second sealing member. The second substrate is pressed against in the stacking direction by another one of the first sealing member and the second sealing member.

In this aspect, by positioning the first substrate of the second flow path member in the first direction and the second direction, the amounts of press of one of the first sealing member and the second sealing member in the first direction and the second direction can be appropriately adjusted. Furthermore, by positioning the second substrate of the second flow path member in the stacking direction, the amount of press of the other one of the first sealing member and the second sealing member in the stacking direction can be appropriately adjusted.

Furthermore, the foregoing flow path member may be fixed to the third flow path member by a screw that is screwed to a screw hole that is provided in the third flow path member and the screw hole may be provided more to a second flow path side in the stacking direction than is the connecting portion between the second flow path and the third flow path. The thus-configured flow path member makes it easy to secure a space for the screw holes and therefore achieve a size reduction.

Either one of the foregoing flow path members may have a filter between the first substrate and the second substrate. According to the thus-configured flow path member, a complicated flow path that includes a filter can be easily formed.

In any one of the foregoing flow path members, the third flow path member may include a positioning pin that is used for the positioning in the first direction and the second direction and a first positioning surface that is used for the positioning in the stacking direction, and the first substrate may include a positioning hole that contacts the positioning pin of the third flow path member in the first direction and the second direction, and the second substrate may include a second positioning surface that contacts the first positioning surface of the third flow path member in the stacking direction. According to the thus-configured flow path member, the positioning pin and the positioning hole allow the highly accurate positioning in the first direction and the second direction, and the first positioning surface and the second positioning surface allow the highly accurate positioning in the stacking direction.

In the foregoing flow path member, the second substrate may include an exposure hole that exposes the positioning hole of the first substrate when viewed in the stacking direction from a proximal end side of the positioning pin to a distal end side of the positioning pin. According to the thus-configured flow path member, the provision of the exposure hole makes it possible to substantially prevent the second substrate from contacting the positioning pin and therefore impeding the positioning.

In any one of the foregoing flow path members, one of the first substrate and the second substrate may include a substrate-positioning pin that carries out positioning of the first substrate and the second substrate relative to each other in the first direction and the second direction and another one of the first substrate and the second substrate may include a substrate-positioning hole that contacts the substrate-positioning pin in the first direction and the second direction. According to the thus-configured flow path member, the first substrate and the second substrate can be positioned relative to each other in the first direction and the second direction. Furthermore, since the first substrate and the second substrate can relatively position each other, the stacking of the second flow path member on the first flow path member or the third flow path member can be performed after the first substrate and the second substrate of the second flow path member are assembled.

In any one of the foregoing flow path members, the first substrate and the second substrate may be provided with the second flow path.

According to a fourth aspect of the invention, there is provided a production method for a liquid ejecting head that includes a second flow path member that includes a second flow path that communicates with a first flow path provided in a first flow path member, a third flow path member that includes a third flow path that communicates with the second flow path of the second flow path member, and a nozzle that ejects a liquid supplied via the first flow path, the second flow path, and the third flow path. The production method includes a first step of fixing a first substrate and a second substrate and forming the second flow path of the second flow path member, a second step of fixing a second sealing member to the third flow path member, a third step of tightly sealing a connecting portion between the second flow path and the third flow path by the second sealing member in a state in which the second sealing member is pressed against in the stacking direction by the second substrate and the third flow path member, carrying out positioning relative to the third flow path member in the stacking direction through use of the second substrate, and carrying out positioning relative to the third flow path member in a first direction and a second direction that intersect with the stacking direction through use of the first substrate, and a fourth step of tightly sealing a connecting portion between the first flow path and the second flow path by the first sealing member in a state in which the first sealing member is pressed against in the first direction and the second direction by the first flow path member and the first substrate.

In this aspect, by positioning the first substrate of the second flow path member in the first direction and the second direction, the amounts of press of one of the first sealing member and the second sealing member in the first direction and the second direction can be appropriately adjusted. Furthermore, by positioning the second substrate of the second flow path member in the stacking direction, the amount of press of the other one of the first sealing member and the second sealing member in the stacking direction can be appropriately adjusted.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter on the basis of exemplary embodiments of the invention.

Exemplary Embodiment 1

Figure 1:
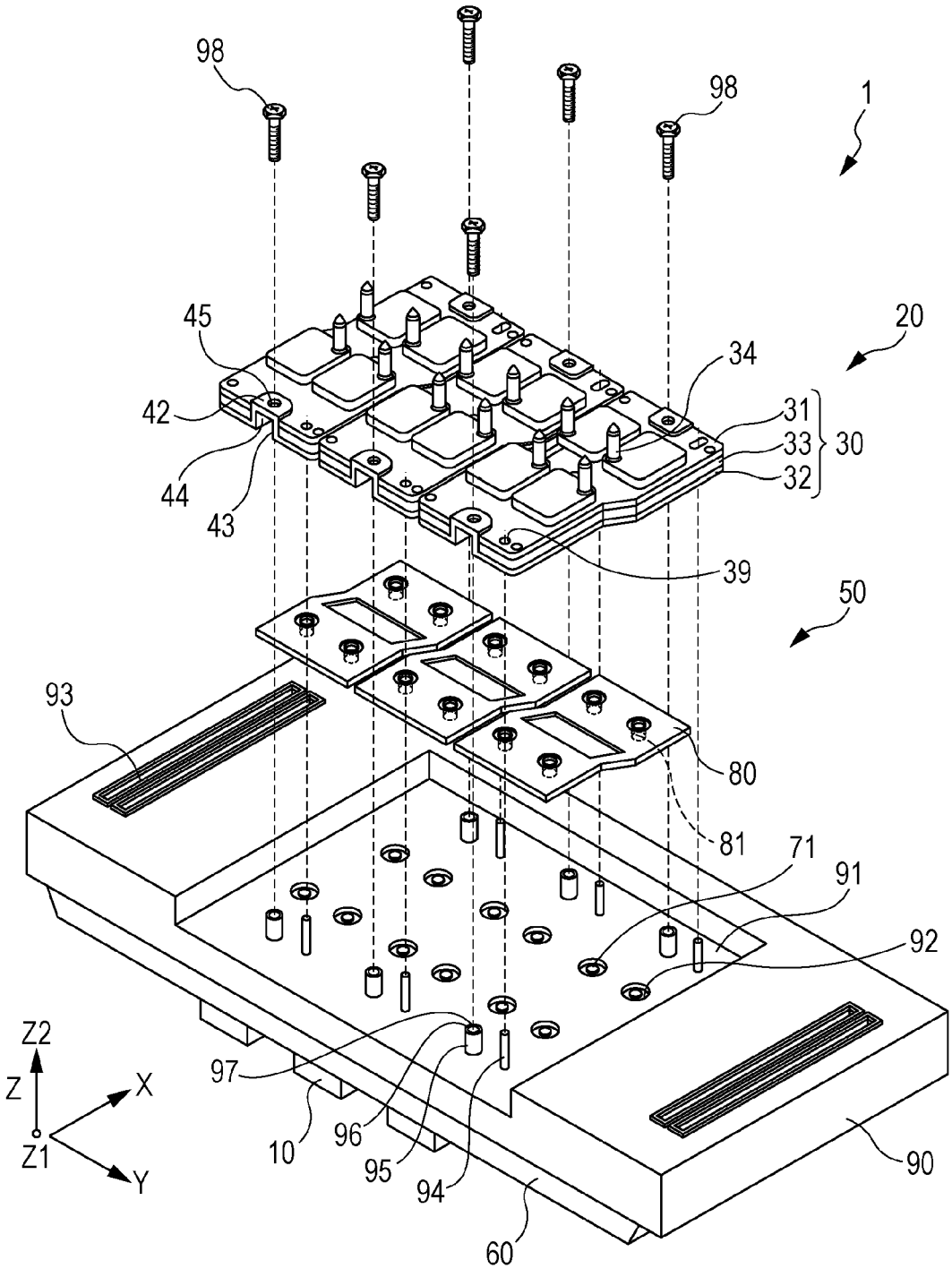
FIG. 1 is an exploded perspective view of a recording head.
Figure 2A:
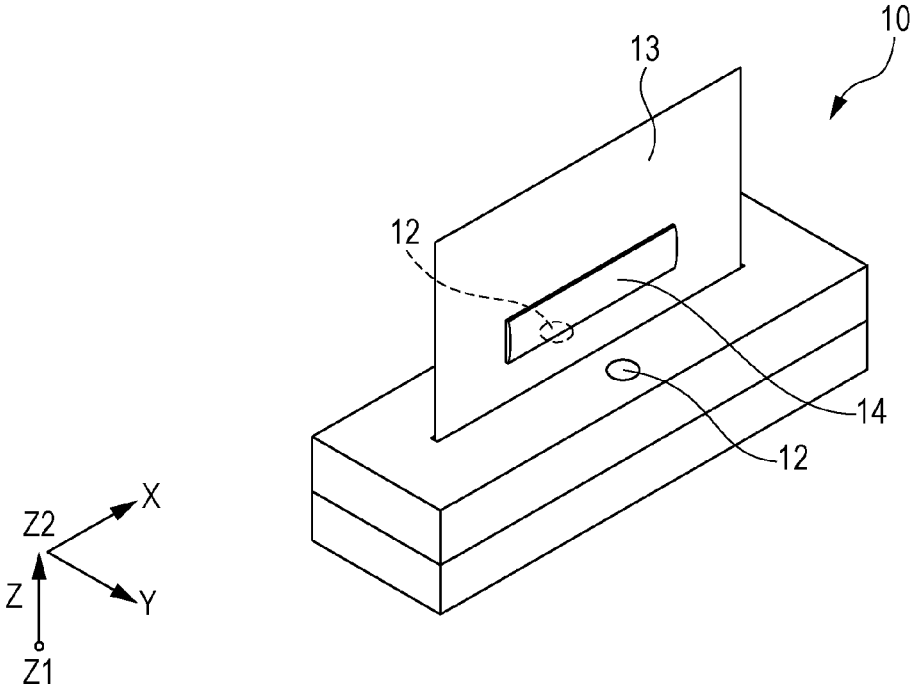
FIGS. 2A and 2B are perspective views of a head body.
Figure 2B:
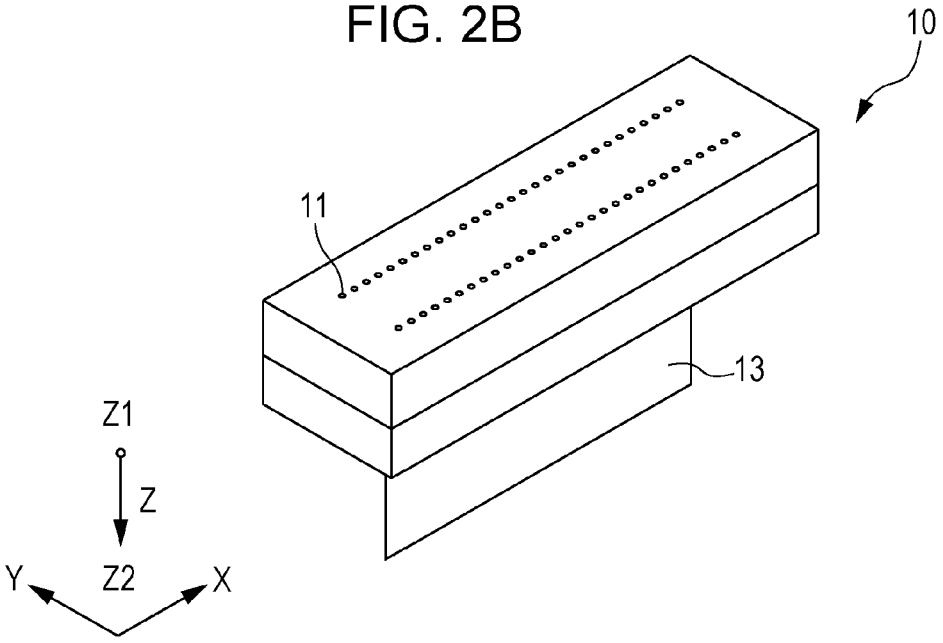

FIG. 1 is an exploded perspective view of an ink jet recording head, which is an example of a liquid ejecting head according to Exemplary Embodiment 1 of the invention. FIGS. 2A and 2B are perspective views of a head body.

As shown in FIG. 1, an ink jet recording head 1 (hereinafter, also referred to simply as recording head 1), an example of the liquid ejecting head of this exemplary embodiment, includes a plurality of head bodies 10 that eject ink drops from nozzles and a flow path member 20 that supports the plurality of head bodies 10 and that is provided with liquid flow paths that supply liquid to the head bodies 10.

As shown in FIGS. 2A and 2B, each head body 10 has, on a one side surface thereof, nozzles 11 that eject ink drops as liquid. The nozzles 11 are juxtaposed in two arrays that are placed side by side in a direction that intersects with the direction in which the nozzles 11 are aligned in each array. With regard to one of the two nozzle arrays, the direction in which the nozzles 11 are juxtaposed will be referred to as first direction X and the array juxtaposition direction in which the nozzle arrays are juxtaposed will be referred to as second direction Y. Furthermore, a direction that intersects with both the first direction X and the second direction Y will be referred to as third direction Z in this exemplary embodiment. In this exemplary embodiment, the directions X, Y and Z are orthogonal to each other; however, the positional relations between various configurations are not necessarily limited to orthogonal relations. In this exemplary embodiment, a side surface of each head body 10 which faces in the third direction Z is a liquid ejection surface in which the nozzles 11 are provided. In this exemplary embodiment, the side in terms of the third direction Z of the head bodies 10 where the nozzles 11 are provided will be referred to as side Z1 and the opposite side of the head bodies 10 to the nozzles 11 will be referred to as side Z2.

Referring to FIG. 2A, the opposite surface of the head body 10, in the third direction Z, to the surface having openings of the nozzles 11 is provided with introduction holes 12 through which ink is introduced into the head body 10. In this exemplary embodiment, each head body 10 has two introduction holes 12 that are juxtaposed in the second direction Y and, in an interior (not shown in the drawing) of the head body 10, each introduction hole 12 communicates with each of the two arrays of nozzles.

The interior (not shown) of each head body 10 is provided with flow paths that communicate with the nozzles 11 and also with the introduction holes 12, pressure generators that cause changes in the pressure of the ink within flow paths, etc. Examples of the pressure generators provided within each head body 10 include a pressure generator that causes changes in the pressure of the ink in a flow path to eject an ink drop from a nozzle 11 by changing the volume of the flow path due to deformation of a piezoelectric actuator that includes a piezoelectric material that exhibits an electromechanical transduction function, a pressure generator that includes a heating element disposed in a flow path so that heat generated by the heating element produces a bubble in the ink to eject an ink drop from a nozzle 11, a pressure generator that uses a so-called electrostatic actuator that generates between a vibration plate and an electrode an electrostatic force by which the vibration plate is deformed to eject an ink drop from a nozzle 11, etc.

Furthermore, a wiring board 13 is protruded in the third direction Z from the surface of each head body 10 in which the introduction holes 12 have openings. The wiring board 13 is connected to the pressure generators provided in the interior (not shown) of the head body 10. The wiring board 13 is made up of flexible connecting wires, for example, a flexible cable or the like, and is disposed between the two introduction holes 12 juxtaposed in the second direction Y so that the planar directions of the wiring board 13 include the first direction X and the third direction Z. The wiring board 13 is packaged with a drive circuit 14 that is a semiconductor element. However, the wiring board 13 does not need to be provided with a drive circuit 14.

Each of these head bodies 10 is fixed, on the surface with the openings of the introduction holes 12, to the flow path member 20 and, via the flow path member 20, is supplied with the ink stored in a liquid storage unit such as an ink cartridge or an ink tank. As shown in FIG. 1, the flow path member 20 is provided with a plurality of head bodies 10. In this exemplary embodiment, six head bodies 10 are provided; more specifically, three head bodies 10 are juxtaposed in an array in the second direction Y, which is the nozzle array juxtaposition direction, and two such arrays are provided side by side in the first direction X. That is, the recording head 1 is provided with a total of 12 nozzle arrays arranged in the first and second directions X and Y. The method of fixing the head bodies 10 to the flow path member 20 is not particularly limited; for example, adhesion with an adhesive or the fastening with screws or the like may be employed. However, since the head bodies 10 are small in size and a plurality of head bodies 10, in this exemplary embodiment, six head bodies 10, need to be attached to the flow path member 20, it is difficult to fix the head bodies 10 to the flow path member 20 via a sealing member made of an elastic material such as rubber or the like. Furthermore, if the head bodies 10 are fixed to the flow path member 20 via a sealing member made of an elastic material such as rubber, the resilient force due to the elasticity of the sealing member may cause the head bodies 10 to develop warpage or the like. Therefore, adhesion of the head bodies 10 to the flow path member 20 with an adhesive is preferred.

Furthermore, as shown in FIG. 1, the flow path member 20 to which the head bodies 10 are fixed includes a plurality of second flow path members 30 and also includes a third flow path member 50 to which a Z1 side of each second flow path member 30 in the third direction Z is fixed.

Figure 3:
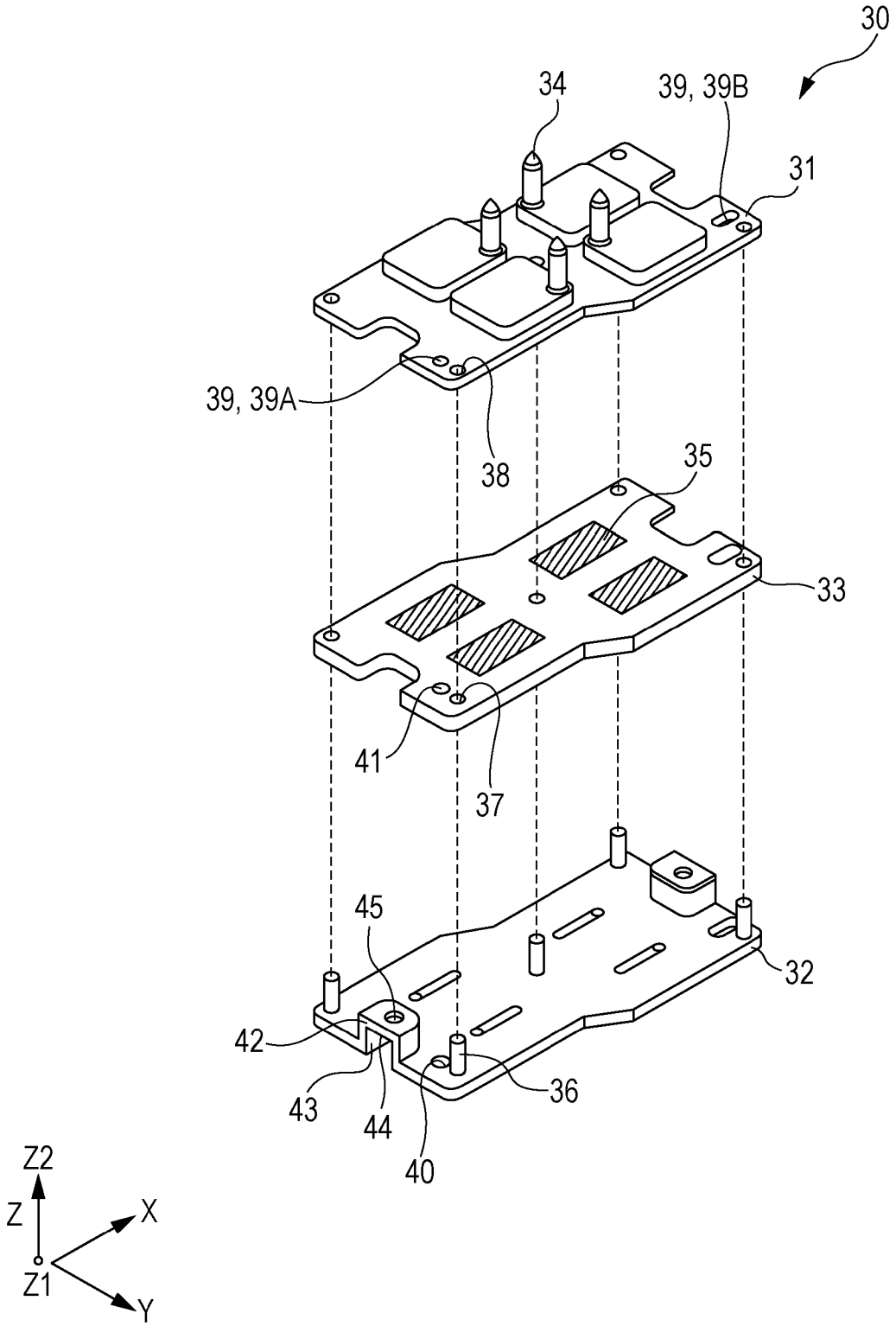
FIG. 3 is an exploded perspective view of a second flow path member.
Figure 4:
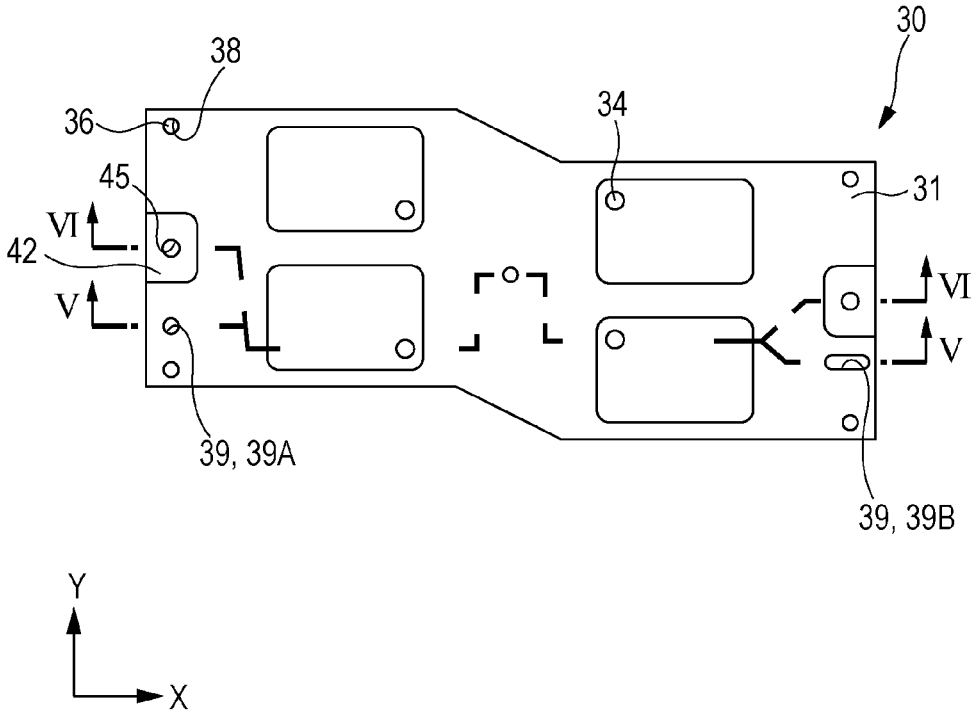
FIG. 4 is a plan view of the second flow path member.
Figure 5:
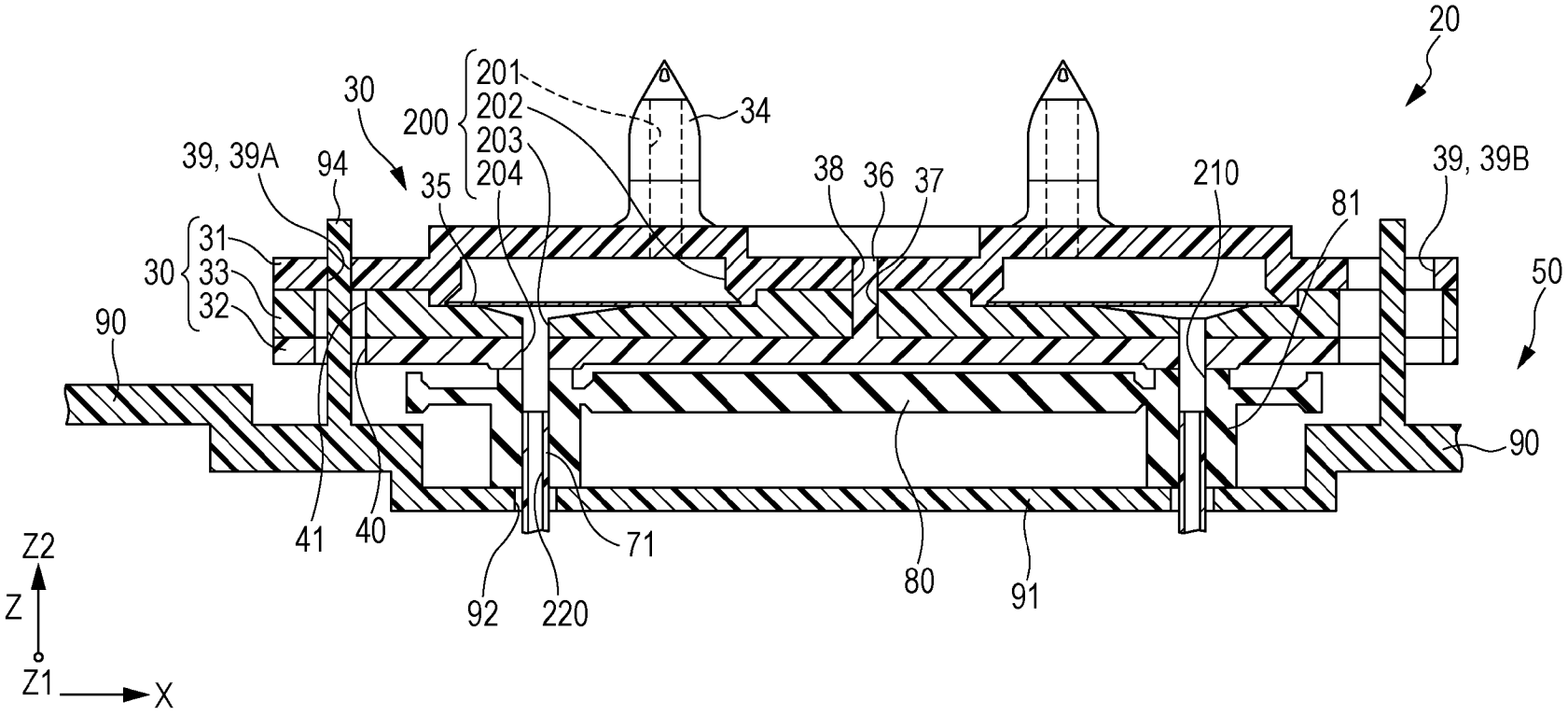
FIG. 5 is a sectional view of portions of a flow path member.
Figure 6:
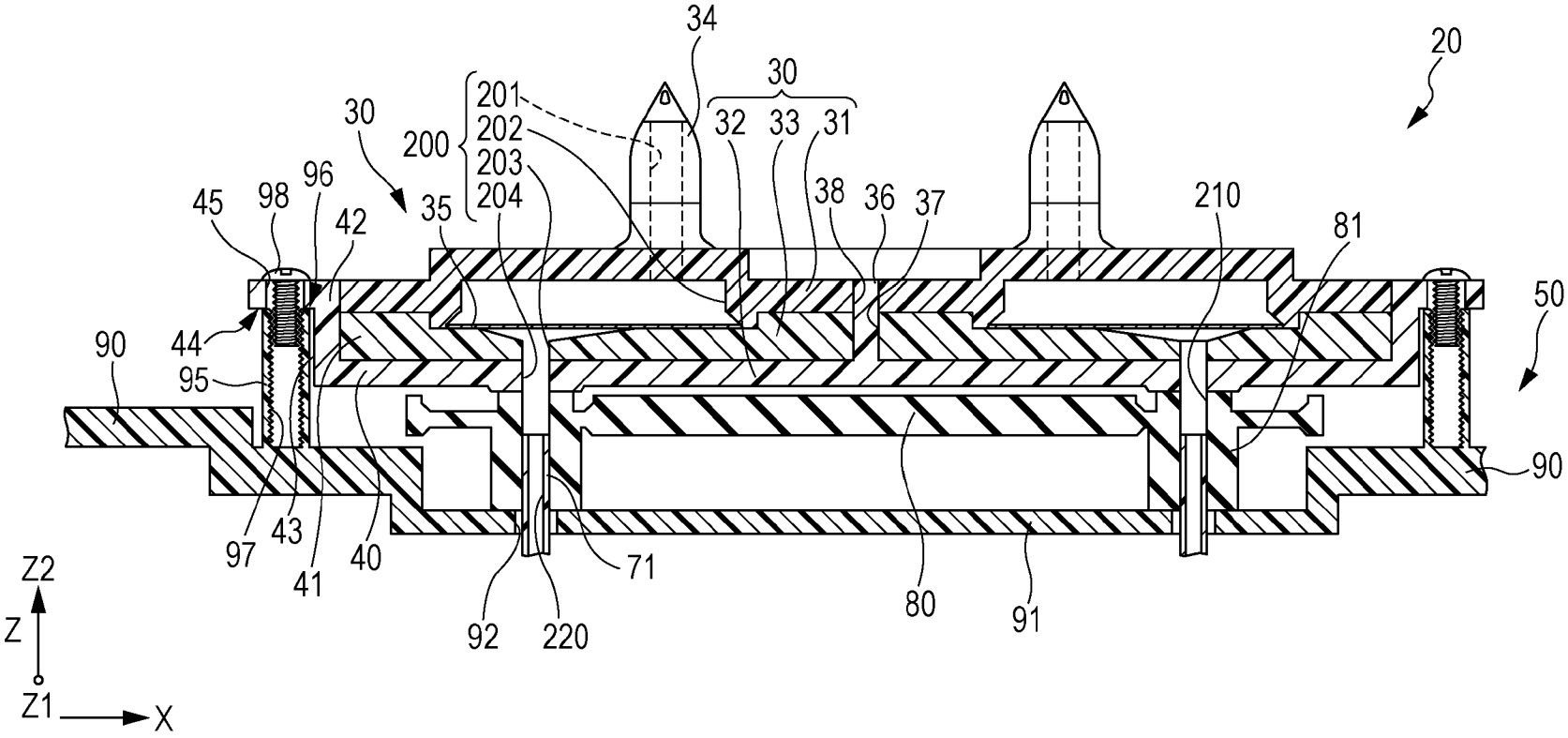
FIG. 6 is another sectional view of portions of the flow path member.

The second flow path members 30 will be further described with reference to FIG. 3 to FIG. 6. FIG. 3 is an exploded perspective view of a second flow path member 30. FIG. 4 is a plan view of the second flow path member. FIG. 5 is a sectional view of portions of the second flow path member taken on the line V-V in FIG. 4. FIG. 6 is a sectional view of portions of the second flow path member taken on the line VI-VI in FIG. 4. The directions of each second flow path member 30 in the following description will be based on the directions of the second flow path member 30 mounted in the recording head, that is, the first direction X, the second direction Y, and the third direction Z.

As shown in FIGS. 5 and 6, the second flow path member 30 has in its interior a connection flow path 200 that is a second flow path connected to the first flow path member (described in detail later).

Furthermore, the second flow path member 30 in this exemplary embodiment has a configuration in which a first substrate 31, a second substrate 32, and an intermediate substrate 33 provided between the first substrate 31 and the second substrate 32 are stacked in the third direction Z. Note that the second flow path member 30 is not limited to this configuration but may have any configuration as long as at least the first substrate 31 and the second substrate 32 are provided, that is, the intermediate substrate 33 may be omitted. Furthermore, two or more intermediate substrates 33 may be provided. The members that constitute the second flow path member 30 are stacked in the same direction as the stacking direction of the second flow path member 30 and the third flow path member 50, that is, the third direction Z. In this exemplary embodiment, the first substrate 31, the intermediate substrate 33, and the second substrate 32 are sequentially stacked from the Z2 side to the Z1 side.

The first substrate 31 has, on its Z2 side, connection portions 34 that are connected to the first flow path member. In this exemplary embodiment, the connection portions 34 are protruded in a needle shape. As shown in FIGS. 5 and 6, inside each connection portion 34 there is provided a first connection flow path 201 that is supplied with ink from a first flow path of the first flow path member. Downstream of the first connection flow path 201 of each connection portion 34 there is provided a liquid pool portion 202 that has been widened to have a larger inside diameter than the first connection flow path 201 provided inside the connection portion 34.

The intermediate substrate 33 is fixed to the Z1 side of the first substrate 31 and has a second connection flow path 203 that communicates with the liquid pool portion 202. A first substrate 31-side opening portion of the second connection flow path 203 is provided with a filter 35 for removing air bubbles and undesired matters contained in ink. The ink supplied from the first connection flow path 201 is supplied into the second connection flow path 203 through the filter 35. Note that the second connection flow path 203 may be formed by, for example, a flow path that extends in the third direction Z, which is the stacking direction of the first substrate 31 and the intermediate substrate 33, a flow path that extends in a direction orthogonal to the third direction Z, for example, in the first direction X or the second direction Y, etc., according to the positional relation with the first connection flow path 201 and to a third connection flow path 204 described below.

The second substrate 32 is fixed to the Z1 side of the intermediate substrate 33. The second substrate 32 is provided with the third connection flow path 204 that communicates with the second connection flow path 203 of the intermediate substrate 33. That is, the connection flow path 200 includes the first connection flow path 201, the liquid pool portion 202, the second connection flow path 203, and the third connection flow path 204. An end of the third connection flow path 204 has an opening on the Z2 side, that is, the intermediate substrate 33 side, and communicates with the second connection flow path 203 of the intermediate substrate 33. Another end of the third connection flow path 204 has an opening in the Z1-side surface of the second substrate 32, that is, the third flow path member 50-side surface thereof.

In this exemplary embodiment, each second flow path member 30 is provided with four connection portions 34 and with four independent connection flow paths 200. Incidentally, the number of connection flow paths 200 provided in a second flow path member 30 is not particularly limited to four but may be, for example, one, or more than one. Furthermore, each connection flow path 200 may branch into two or more paths, for example, past the filter 35 toward the opposite side from the connection portion 34 side. It is also permissible that the connection flow path 200 branch into two or more paths at the upstream side of the filter 35. Furthermore, in a boundary portion between the second substrate 32 and the intermediate substrate 33, the flow path may extend in the first direction X and the second direction Y.

The second flow path member 30 as described above can be molded of a resin material so that costs will be low. However, the material of the second flow path member 30 is not limited to resin materials; for example, the second flow path member 30 may be formed from a metal material or the like. Likewise, the production method for the second flow path member 30 is not limited to molding.

Furthermore, the first substrate 31, the second substrate 32, and the intermediate substrate 33 that constitute the second flow path member 30 are stacked in the third direction Z, for example, using an adhesive, a thermal welding process, etc. In this exemplary embodiment, the second substrate 32 is provided with substrate-positioning pins 36 protruding toward the intermediate substrate 33 and the first substrate 31, that is, to the Z2 side in the third direction Z. In this exemplary embodiment, a total five substrate-positioning pins 36 are provided in four corner portions and a central portion of the second substrate 32 in a plan view taken from the third direction Z. The intermediate substrate 33 has, corresponding to the substrate-positioning pins 36, five intermediate substrate-positioning holes 37 through which the substrate-positioning pins 36 are inserted. Also corresponding to the substrate-positioning pins 36, the first substrate 31 has substrate-positioning holes 38 into which the substrate-positioning pins 36 are inserted. Therefore, by inserting the substrate-positioning pins 36 of the second substrate 32 through the intermediate substrate-positioning holes 37 of the intermediate substrate 33 and into the substrate-positioning holes 38 of the first substrate 31, the first substrate 31, the second substrate 32, and the intermediate substrate 33 are fixed in position (i.e., positioned) relative to each other in the first direction X and the second direction Y. Specifically, outer peripheral surfaces of the substrate-positioning pins 36 of the second substrate 32 have firm contact in the first direction X and the second direction Y with inner peripheral surfaces of the intermediate substrate-positioning holes 37 of the intermediate substrate 33 and inner peripheral surfaces of the substrate-positioning holes 38 of the first substrate 31, whereby the first substrate 31, the second substrate 32, and the intermediate substrate 33 are fixed in position, that is, positioned, relative to each other in the first direction X and the second direction Y. Incidentally, although in this exemplary embodiment, the substrate-positioning pins 36 are provided on the second substrate 32, this configuration is not restrictive. The first substrate 31 may be provided with substrate-positioning pins 36 and the second substrate 32 may be provided with substrate-positioning holes 38. It is also permissible that the intermediate substrate 33 be provided with substrate-positioning pins 36 and both the first substrate 31 and the second substrate 32 be provided with substrate-positioning holes 38. Furthermore, although in the exemplary embodiment, the intermediate substrate-positioning holes 37 and the substrate-positioning holes 38 are through holes which extend in the third direction Z and whose inner peripheral surfaces are continuous in the circumferential direction, this is not restrictive. For example, the intermediate substrate-positioning holes 37 and the substrate-positioning holes 38 may be of a generally termed cutout shape whose inner peripheral surface is not continuous all along the circumference but has a partial depletion that allows communication with the outside. That is, the substrate-positioning holes 38 and the intermediate substrate-positioning holes 37 include cutouts in meaning. Furthermore, although the substrate-positioning holes 38 in this exemplary embodiment are through holes that penetrate in the third direction Z, this is not restrictive. That is, the substrate-positioning holes 38 do not need to extend through the first substrate 31 in its thickness direction. Specifically, the substrate-positioning pins 36 do not need to be exposed in the surface of the second flow path member 30.

The first substrate 31 is provided with positioning holes 39 through which positioning pins 94 provided on the third flow path member 50 extend. The positioning pins 94 of the third flow path member 50 are protruded to the Z2 side in the third direction Z, that is, to the second flow path member 30 side. In this exemplary embodiment, the positioning holes 39 are a first positioning hole 39A and a second positioning hole 39B. The first positioning hole 39A is a simple hole whereas the second positioning hole 39B is an elongated hole whose long axis lies toward the first positioning hole 39A. Note that if at least two positioning holes 39 are provided, the positioning holes 39 are able to carry out the positioning in the first direction X and the second direction Y. Furthermore, if a positioning hole 39 has an opening shape that is triangular, quadrangular, or the like, that even one positioning hole 39 alone can carry out the positioning in the first direction X and the second direction Y. Of course, three or more positioning holes 39 may be provided. However, it is to be noted that if at least two positioning holes 39 are provided as far apart from each other as possible, the highly accurate positioning in the first direction X and the second direction Y can be carried out.

Furthermore, the second substrate 32 has, corresponding to the positioning holes 39 of the first substrate 31, exposure holes 40 that expose the positioning holes 39 when viewed from the Z1 side in the third direction Z. Specifically, in a view of the positioning holes 39 from the Z1 side in the third direction Z, that is, in a view from a proximal end side toward a distal end side of the positioning pins 94, each exposure hole 40 of the second substrate 32 exposes the adjacent one of the positioning holes 39 of the first substrate 31 without the second substrate 32 covering an inner peripheral edge portion of the adjacent positioning hole 39. In this exemplary embodiment, each exposure hole 40 is a through hole which extends through the second substrate 32 in the thickness direction and whose inner peripheral surface continuously extends in the circumferential directions and which has a larger inside diameter than the adjacent positioning hole 39.

Incidentally, it suffices that each exposure hole 40 exposes the peripheral edge portion of the adjacent one of the positioning holes 39 in a view from the Z1 side. The exposure holes 40 are not limited to through holes but may be of a so-called cutout shape whose inner peripheral surface does not continuously extend all along the circumference but has a partial depletion that allows communication with the outside.

Likewise, the intermediate substrate 33 is provided with at least two intermediate exposure holes 41 that correspond in position to the positioning holes 39 and that expose the positioning holes 39 in a view from the Z1 side in the third direction Z. Each intermediate exposure hole 41 is a through hole that extends through the intermediate substrate 33 in the third direction Z and that has the same inside diameter as an adjacent one of the exposure holes 40 of the second substrate 32. Similarly to the exposure holes 40, the intermediate exposure holes 41 may be of a cutout shape.

The second substrate 32 is provided with at least two protrusion portions 42 protruded to the first substrate 31 side. Inside each protrusion portion 42 there is provided a recess portion 43 that is open to the Z1 side. Each recess portion 43 in this embodiment has an opening also in a side surface, that is, an opening that faces in the first direction X. A bottom surface of each of these recess portions 43, that is, a surface thereof that faces the third flow path member 50, forms a second positioning surface 44 that is fixed in position, that is, positioned, by the third flow path member 50. That is, because of being provided inside the protrusion portions 42, the second positioning surfaces 44 are provided on the second substrate 32 side.

Figure 7:
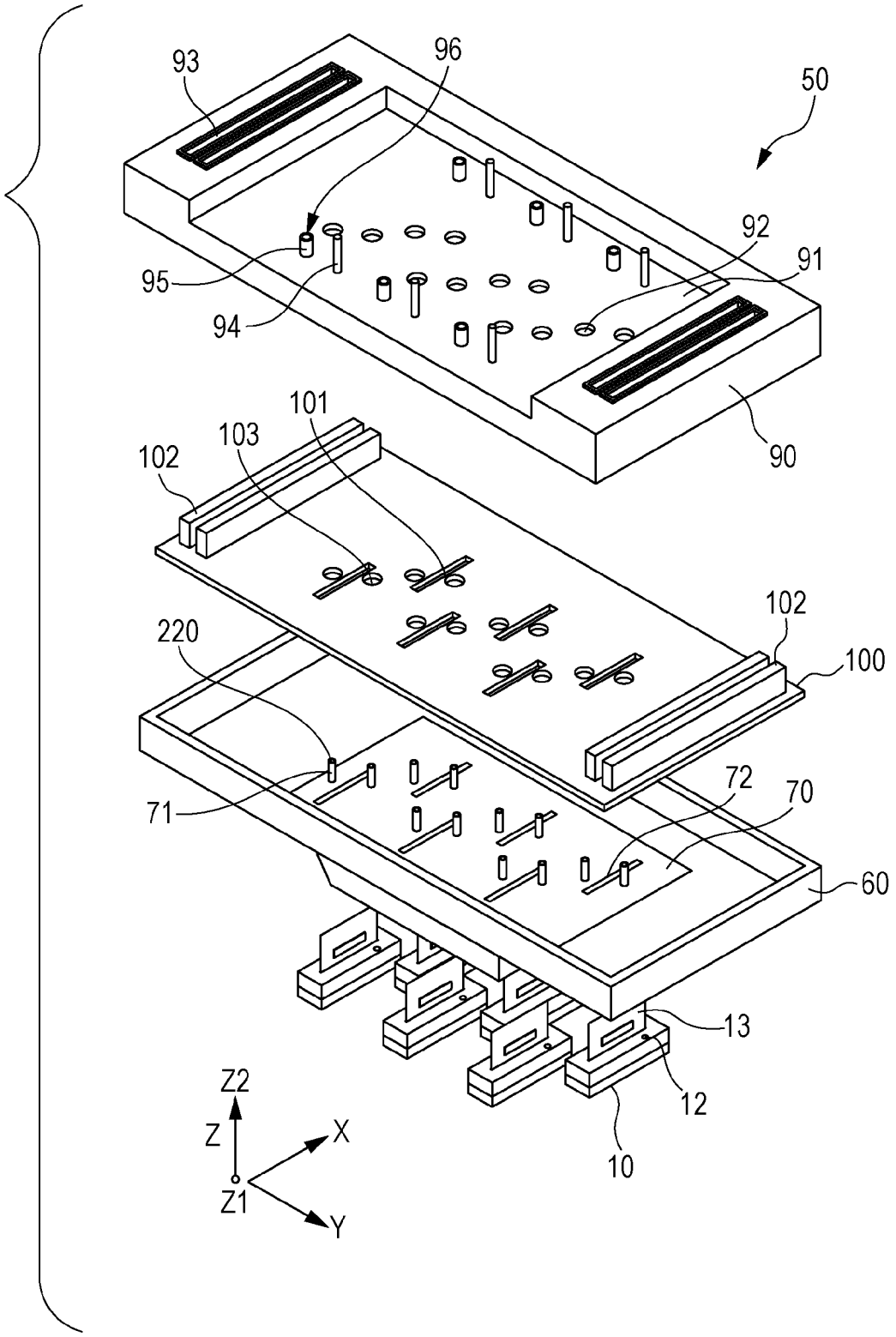
FIG. 7 is an exploded perspective view of a third flow path member.
Figure 8:
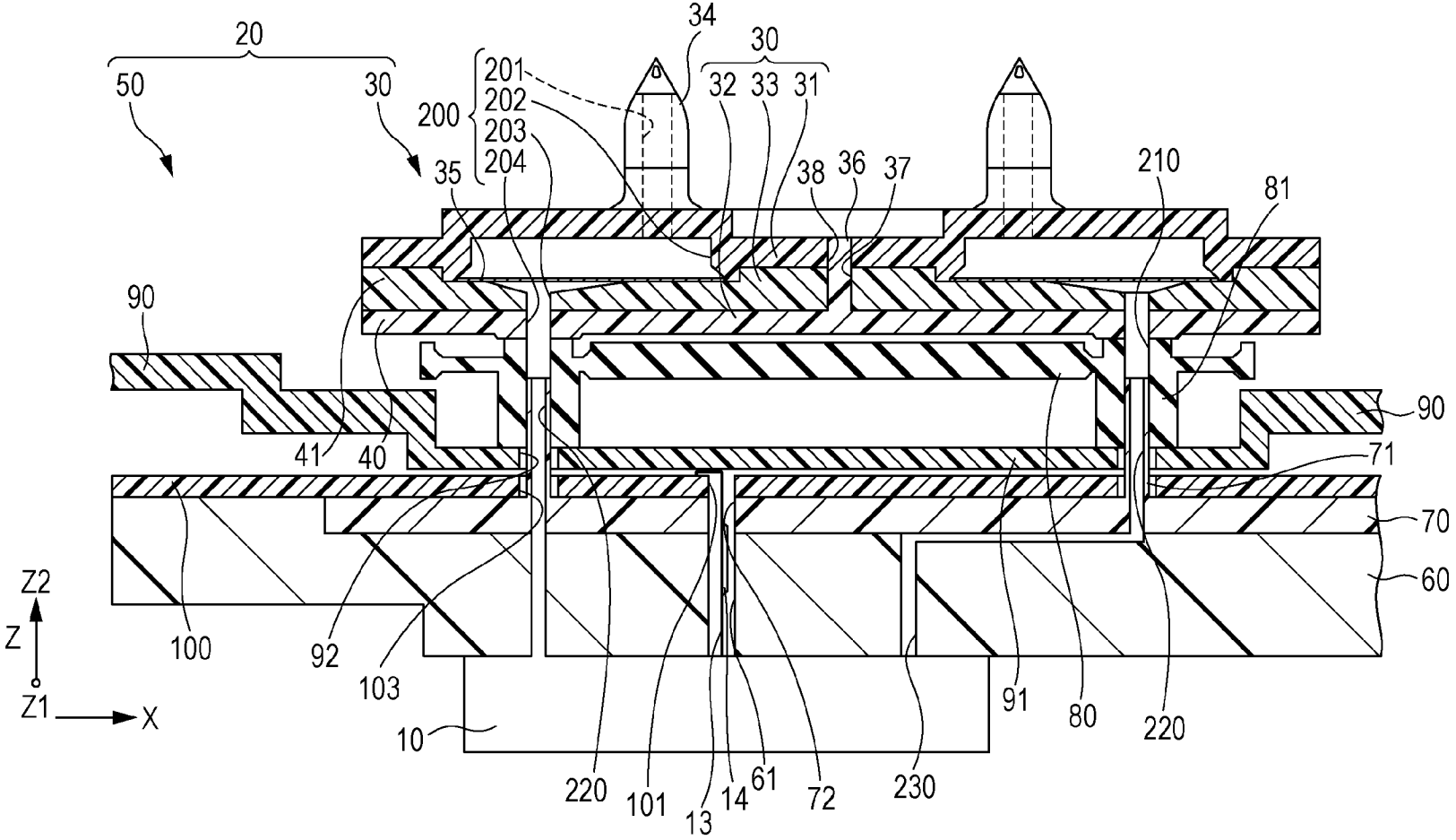
FIG. 8 is a sectional view of portions of a recording head.

The third flow path member 50 to which the foregoing second flow path member 30 is fixed will be further described with reference to FIGS. 7 and 8. FIG. 7 is an exploded perspective view showing the third flow path member 50. FIG. 8 is a sectional view of portions of a recording head.

As shown in FIGS. 7 and 8, the third flow path member 50 includes a holder 60 that is in contact with the head bodies 10, an over-the-holder member 70 disposed between the holder 60 and the second flow path member 30, a second sealing member 80 sandwiched between the over-the-holder member 70 and the second flow path member 30, and a support member 90 that supports the second sealing member 80.

The support member 90 is a member to whose Z2 side in the third direction Z the second flow path member 30 is fixed and to whose Z1 side the holder 60 is fixed. The second sealing member 80 is provided between the support member 90 and the second flow path member 30. The second sealing member 80 connects the connection flow paths 200 of the second flow path member 30 and tubular flow paths 220 that are third flow paths of the over-the-holder member 70 provided between the holder 60 and the support member 90.

Note that the second sealing member 80 may be made of an elastic material that has liquid resistance to a liquid, such as ink, for use in the recording head 1 and that is elastically deformable. Examples of the elastic material for the second sealing member 80 include a rubber and an elastomer. Furthermore, the second sealing member 80 includes tubular portions 81 that are provided for each of branching outlets of the connection flow paths 200. Each tubular portion 81 has a through hole 210 that extends through the tubular portion 81 in the third direction Z. Although detailed below, the through holes 210 of the tubular portions 81 provide communication between the connection flow paths 200 of the second flow path members 30 and the tubular flow paths 220 of the over-the-holder member 70. These tubular portions 81 are interconnected by platy portions of the individual second flow path members 30 so that a plurality of tubular portions 81 are firmly interlinked for each one of the second flow path members 30. In this exemplary embodiment, since each second flow path member 30 is provided with four outlets of the connection flow paths 200 which have openings on the support member 90 side, each second sealing member 80 has four tubular portions 81 that are provided integrally with the second sealing member 80. Furthermore, in this exemplary embodiment, since the flow path member 20 includes three second flow path members 30, the number of the second sealing members 80, which equals the number of the second flow path members 30, is three.

As for the platy portion of each second flow path member 30 which continuously interlinks the tubular portions 81 of a second sealing member 80, regions that contact the tubular portions 81 are provided with a greater thickness than the other regions. Therefore, when a side surface of a second sealing member 80 is brought into contact with the surface of a second flow path member 30 in which the connection flow paths 200 of the second flow path member 30 have openings, end surfaces of the tubular portions 81 alone come into contact with regions around the openings of the connection flow paths 200. The thus-reduced areas of contact increase the pressure for tight sealing so that leakage of ink can be substantially prevented.

Incidentally, the through holes 210 of the tubular portions 81 have substantially the same inside diameter as the openings of the connection flow paths 200 of the second flow path members 30. The outside diameter of the tubular portions 81 is larger than the inside diameter of the openings of the connection flow paths 200. Therefore, the surface of the second flow path member 30 in which the connection flow paths 200 have openings and the end surfaces of the tubular portions 81 in which the through holes 210 have openings can be placed in contact with each other in the third direction Z, which is the penetrating direction of the through holes 210, so that the connection flow paths 200 and the through holes 210 communicate with each other. That is, the connection flow paths 200 and the through holes 210 are interconnected in such a manner that the second flow path member 30 and the second sealing member 80 are in a sealing contact with each other, with a pressure applied in the third direction Z, which is the penetrating direction of the through holes 210. More specifically, the second substrate 32 provided on the third flow path member 50 side of the second flow path member 30 is pressed against in the third direction Z by the second sealing member 80, so that the connection flow paths 200 that are second flow paths of the second flow path member 30 and the tubular flow paths 220 that are third flow paths of the third flow path member 50 are interconnected in a tightly sealed state.

Note that when the end surfaces of the tubular portions 81 of the second sealing member 80 and the surface of the second flow path member 30 in which the connection flow paths 200 have openings, that is, the surface of the second substrate 32, are put into a firm contact with each other by a predetermined pressure in the third direction Z, the tubular portions 81 of the second sealing member 80 elastically deform to the head body 10-side in the third direction Z. Therefore, the support member 90 is provided with a support portion 91 that supports the tubular portions 81 of the second sealing member 80. This support portion 91 contacts the Z1-side end surfaces of the tubular portions 81 of the second sealing member 80 which are the surfaces opposite to the Z2-side end surfaces of the tubular portions 81 which contact the second flow path member 30 and therefore restrict movement of the tubular portions 81 to the holder 60 side in the third direction Z. Because the support portion 91 of the support member 90 supports the head body 10-side end surfaces of the tubular portions of the second sealing member 80, the stress in the third direction Z in the second flow path member 30 and the tubular portions 81 of the second sealing member 80 is supported. That is, since the resilient force due to the elastic deformation of the second sealing member 80 is supported by the support portion 91 of the support member 90, the resilient force of the second sealing member 80 is not applied to the over-the-holder member 70 side, so that deformation of the holder 60 and the over-the-holder member 70, inclination of the liquid ejection surface of the head body 10, etc. can be reduced or substantially prevented.

The support portion 91 is provided with first projected portion insertion holes 92 into which projected portions 71 (detailed below) of the over-the-holder member 70 are inserted. The first projected portion insertion holes 92 have an inside diameter that is slightly larger than the outside diameter of the projected portions 71 of the over-the-holder member 70 and that is slightly smaller than the outside diameter of the tubular portions 81 of the second sealing member 80. Therefore, opening edge portions of the first projected portion insertion holes 92 and the end surfaces of the tubular portions 81 of the second sealing member 80 can be placed in contact with each other.

Incidentally, if the support member 90 is molded of a resin material, the support member 90 can be formed at low costs. However, the material of the support member 90 is not limited to resin materials but may also be a metal material or the like, and the production method for the support member 90 is not limited to molding.

Furthermore, the over-the-holder member 70 is provided on the opposite side of the support member 90 to the second sealing member 80, and the holder 60 is provided on the opposite side of the over-the-holder member 70 to the support member 90. That is, the over-the-holder member 70 is disposed between the holder 60 and the second flow path member 30 and, in this exemplary embodiment, between the holder 60 and the support member 90.

The over-the-holder member 70 is provided with the projected portions 71 that are protruded in the third direction Z, that is, to the second sealing member 80 side. A distal end surface of each projected portion 71 is provided with an opening of an end of a tubular flow path 220. That is, each projected portion 71 has a tubular shape and the inside of each projected portion 71 is provided with a tubular flow path 220. The projected portions 71 each having a tubular flow path 220 are provided corresponding to the introduction holes 12 of the head bodies 10, that is, two projected portions 71 are provided for each one of the head bodies 10.

Note that one of the two introduction holes 12 of each head body 10 communicates with a tubular flow path 220 that is linear, that is, straight, in the third direction Z, which is the stacking direction of the head bodies 10 and the second flow path members 30. Note that a tubular flow path being straight in the third direction Z means that the ink in the tubular flow path 220 flows only along the third direction Z without flowing along the first direction Z or the second direction Y. The other one of the introduction holes 12 of each head body 10 communicates with a tubular flow path 220 a part of which extends horizontally along the first direction X and the second direction Y between the over-the-holder member 70 and the holder 60. Therefore, the two connection flow paths 200 that communicate with the two introduction holes 12 of a head body 10 can be disposed at different positions in the first direction X and the second direction Y according to the second flow path member 30.

The projected portions 71 each provided with a tubular flow path 220 as described above have an outside diameter that is slightly smaller than the inside diameter of the first projected portion insertion holes 92 of the support portion 91, and are inserted in the first projected portion insertion holes 92 of the support portion 91. An outer periphery of the projected portion 71 inserted in each first projected portion insertion hole 92 is fitted to a tubular portion 81 of the second sealing member 80 so that the tubular flow path 220 of the projected portion 71 and the through hole 210 of the tubular portion 81 are connected. Note that the inside diameter of the through holes 210 of the tubular portions 81 of the second sealing members 80 is slightly smaller than the outside diameter of the projected portions 71. Therefore, each of the tubular portion 81 of the second sealing members 80, when receiving a projected portion 71, elastically deforms so as to increase the inside diameter of the through hole 210. Thus, the inner peripheral surface of the through hole 210 produces pressure force in the directions of normals to the outer peripheral surface of the projected portion 71, for example, the first direction X and the second direction Y, so that close contact is achieved between the two surfaces. That is, the tubular flow path 220 and the through hole 210 are sealed together as an outside surface of the tubular flow path 220 and an inside surface of the through hole 210 closely contact each other with pressure applied in directions orthogonal to the third direction Z, which is the stacking direction of the second flow path member 30 and the holder 60, in other words, in the radial directions of the through hole 210.

Thus, the second sealing member 80 tightly seals its connecting portions with the tubular flow paths 220 of the over-the-holder member 70 by exerting pressure to each tubular flow path 220 in the radial directions of the tubular flow path 220, that is, the directions orthogonal to the third direction Z, thus substantially preventing an incident in which the second sealing member 80 is elastically deformed in the third direction Z, that is, a direction orthogonal to the planar directions of the liquid ejection surface, and therefore the resilient force due to the elastic deformation presses a head body 10. This will substantially prevent detachment of a head body 10 from the flow path member 20 and detachment of a stacked member (not shown) stacked in the third direction Z to form a head body 10 and also substantially prevent warpage of the liquid ejection surface of a head body 10 and therefore deviation of the drop landing positions on an ejection-object medium of ink drops ejected from the nozzles 11 of the warped liquid ejection surface.

On the other hand, the second sealing member 80 seals its connecting portions with the connection flow paths 200 of the second flow path member 30 by exerting pressure to the connection flow paths 200 in the flowing direction of ink, that is, the third direction Z, as described above. However, in this exemplary embodiment, the support portion 91 gives support in the third direction Z to the regions of the second sealing member 80 in which the second flow path member 30 presses the second sealing member 80. Therefore, the pressing force that the second flow path member 30 exerts on the second sealing member 80 in the third direction Z is supported by the support portion 91. Then, the support member 90 that includes the support portion 91 is fixed to the holder 60, with a predetermined space provided between the support portion 91 and the holder 60. The fixing regions between the support member 90 and the holder 60 do not overlap with the nozzles 11 when viewed in the third direction Z Therefore, due to the pressure that the second flow path member 30 exerts on the second sealing member 80, the second sealing member 80 elastically deforms. The resilient force due to the elastic deformation of the second sealing member 80 is supported by the support portion 91 and dispersed to the securement regions where the support member 90 having the support portion 91 and the holder 60 are fixed to each other. Therefore, the pressure exerted on the second sealing member 80 can be substantially prevented from acting on a head body 10 and, particularly, regions around the nozzles 11. As a result, the detachment of a stacked member that constitutes a head body 10, the detachment of a head body 10 from the flow path member 20, the deviation of the landing position of ink drops due to warpage of the liquid ejection surface of a head body 10, etc. can be substantially prevented.

Furthermore, because the second flow path member 30 and the second sealing member 80 are connected by applying pressure in the flowing direction of ink, that is, the third direction Z, the second flow path member 30 and the second sealing member 80 can be easily positioned relative to each other and connected to each other. Note that tubular projected portions each having an internally extending connection flow path 200 may be provided in the second flow path member 30 so that an outer periphery of each projected portion is fitted to a corresponding one of the tubular portions 81 of the second sealing member 80 to connect the connection flow paths 200 and the through holes 210 of the tubular portions 81. However, this requires that the projected portions of the second flow path member 30 be simultaneously inserted into the tubular portions 81 of the second sealing member 80, and thus decreases the ease of operation. In particular, the connecting portions between the second flow path member 30 and the second sealing member 80 are hidden by the support member 90 or the like, so that visual inspection is not easy and it sometimes cannot be checked whether a connection is precise. Furthermore, in the case where the second flow path member 30 is provided with projected portions, if there occurs a deviation between the positions of the projected portions of the second flow path member 30 and the positions of the plurality of tubular portions 81 of the second sealing member 80 connected to the projected portions 71 of the over-the-holder member 70, it may be necessary to bend tubular portions 81, giving rise to a risk of a sealing failure leading to leakage of ink and other defective conditions. In this exemplary embodiment, the second flow path member 30 and the second sealing member 80 are brought into mutual contact in the third direction Z so that pressure can be applied in the third direction Z to tightly seal the connecting portions between the connection flow paths 200 and the through holes 210. Therefore, the second flow path member 30 and the second sealing member 80 can easily be positioned relative to each other without a need for visual checking. Furthermore, even if there occurs an error in the positions of the connection flow paths 200 relative to the tubular portions 81, the force exerted on the tubular portions 81 in such a direction as to bend the tubular portions 81 can be reduced so that the leakage of ink due to a sealing failure can be substantially prevented. This over-the-holder member 70 can be formed at low costs by molding it of a resin material.

Furthermore, the over-the-holder member 70 is fixed to the holder 60 via an adhesive or the like. The holder 60 is provided with communication flow paths 230 that communicate with the tubular flow paths 220 of the over-the-holder member 70 and that communicate with the introduction holes 12 of the head bodies 10. The communication flow paths 230 extend linearly, that is, straight, in the third direction Z. Therefore, the ink supplied from the connection flow paths 200 of the second flow path member 30 is supplied to the introduction holes 12 of the head bodies 10 through the through holes 210, the tubular flow paths 220, and the communication flow paths 230.

Incidentally, the holder 60 described above can be formed at low costs by molding it of a resin material. However, the material of the holder 60 is not limited to resin materials but may also be a metal material or the like. Furthermore, the production method for the holder 60 is not limited to molding.

The holder 60 described above has, for each head body 10, two communication flow paths 230 that are connected to that head body 10 and a first wiring insertion hole 61 for the head body 10 between the two communication flow paths 230. The first wiring insertion holes 61 extend through the holder 60 in the third direction Z. Furthermore, the over-the-holder member 70 is provided with second wiring insertion holes 72 penetrating therethrough in the third direction Z which communicate one-to-one with the first wiring insertion holes 61. The wiring boards 13 of the head bodies 10 fixed to the holder 60 are extracted to the opposite side of the over-the-holder member 70 to the holder 60, through the first wiring insertion holes 61 and the second wiring insertion holes 72.

Furthermore, between the over-the-holder member 70 and the second sealing member 80 there is provided a relay board 100 to which the wiring boards 13 of the head bodies 10 are connected.

The relay board 100 has connection holes 101 which communicate one-to-one with the second wiring insertion holes 72 of the over-the-holder member 70 and through which the wiring boards 13 of the head bodies 10 are inserted. The wiring boards 13 inserted through the connection holes 101 are electrically connected to the relay board 100 on the second sealing member 80-side of the relay board 100. The relay board 100 described above is provided with wirings, electronic component parts, etc. that are connected to the wiring boards 13. Furthermore, the relay board 100 is provided with connectors 102 to which external wires (not shown) inserted through wiring connection holes 93 provided in the support member 90 are connected. Furthermore, the relay board 100 is provided with second projected portion insertion holes 103 through which the projected portions 71 of the over-the-holder member 70 are inserted. The projected portions 71 are inserted through the second projected portion insertion holes 103 of the relay board 100 and the first projected portion insertion holes 92 of the support member 90 and are connected to the through holes 210 of the second sealing member 80.

In this exemplary embodiment, only one head relay board 100 as described above is provided for the plurality of head bodies 10. Therefore, the wiring boards 13 of the plurality of head bodies 10 can be connected collectively to an external wiring, so that the connection to an external wiring can be simplified. Of course, a plurality of relay boards 100 may be provided.

The second flow path member 30 is fixed to the third flow path member 50 described above. Concretely, the support member 90 that constitutes the third flow path member 50 has two positioning pins 94 and two protruded portions 95 for each second flow path member 30.

The positioning pins 94 have a cylindrical shape protruded to the Z2 side and are provided corresponding one-to-one to the positioning holes 39 of the second flow path member 30. The positioning pins 94, as shown in FIG. 5, are inserted through the positioning holes 39 from the exposure hole 40 side of the second flow path member 30. As a result, the positioning pins 94 and the positioning holes 39 are fixed in the position in the first direction X and the second direction Y. That is, the outer peripheral surfaces of the positioning pins 94 and inner peripheral surfaces of the positioning holes 39 are caused to contact each other in the first direction X and the second direction Y so that the second flow path member 30 is positioned in the first direction X and the second direction Y relative to the third flow path member 50. In this exemplary embodiment, inserting a positioning pin 94 into a first positioning hole 39A fixes the position of the first positioning hole 39A in the first direction X and the second direction Y and inserting a positioning pin 94 into a second positioning hole 39B fixes the angular position in the direction of rotation about the first positioning hole 39A. Furthermore, since the exposure holes 40 and the intermediate exposure holes 41 of the second flow path member 30 have larger inside diameters than the positioning holes 39, the exposure holes 40 and the intermediate exposure holes 41 do not impede the positioning of the positioning pins 94 and the positioning holes 39. That is, in a construction in which the exposure holes 40 and the intermediate exposure holes 41 have the same inside diameter as the positioning holes 39, there is a risk that if the first substrate 31, the second substrate 32, and intermediate substrate 33 deviate in the first direction X or the second direction Y, a peripheral edge portion of a positioning hole 39 will be covered by the second substrate 32 or the intermediate substrate 33. In this exemplary embodiment, since the exposure holes 40 and the intermediate exposure holes 41 expose the positioning holes 39, the positioning can be certainly carried out by using the positioning pins 94 and the positioning holes 39. That is, the positioning of the second flow path member 30 in the first direction X and the second direction Y relative to the third flow path member 50 is accomplished by the first substrate 31. By fixing the positions of the second flow path members 30 in the first direction X and the second direction Y relative to the third flow path member 50 as described above, the relative positions of the connection portions 34 of the plurality of second flow path members 30 in the first direction X and the second direction Y can be fixed. That is, it suffices that the positioning holes 39 are provided at positions that are defined relative to the connection portions 34. Therefore, when the first flow path members (detailed below) are to be connected to the connection portions 34, the plurality of first flow path members can be simultaneously positioned with high accuracy relative to the connection portions 34 and therefore connected to the connection portions 34, so that leakage of ink can be substantially prevented.

On the other hand, the protruded portions 95 provided on the support member 90, in this exemplary embodiment, have a cylindrical shape protruded to the Z2 side and are provided corresponding to the insides of the recess portions 43. As for the protruded portions 95, as shown in FIG. 6, a distal end surface thereof is provided as a first positioning surface 96 and makes a contact in the third direction Z with a second positioning surface 44 that is a bottom surface of a corresponding one of the recess portions 43 of the second flow path member 30 so that the second flow path member 30 is positioned in the third direction Z relative to the third flow path member 50. That is, each second flow path member 30 is positioned in the third direction Z relative to the third flow path member 50 by the second substrate 32. By positioning the second flow path members 30 in the third direction Z relative to the third flow path member 50 through the use of the second substrate 32 provided on the third flow path member 50 side as described above, the pressure exerted on the second sealing member 80 between the second substrate 32 and the support member 90 can be highly accurately adjusted. Incidentally, in a construction in which the first substrate 31 is provided with second positioning surfaces as described above, the pressure exerted on the second sealing member 80 between the second substrate 32 and the support member 90 varies due to dimensional variations of members, such as the first substrate 31, the second substrate 32, and the intermediate substrate 33, variations in the thickness of the adhesive used in a stacking process, etc. Then, if the pressure exerted on the second sealing member 80 in the third direction Z is low, there is a risk of a sealing failure and therefore leakage of ink. Furthermore, if the pressure exerted on the second sealing member 80 in the third direction Z is excessively high, there is a risk that the second sealing member 80 may be bent or distorted and therefore stress may occur in the second sealing member 80 in the direction X and the direction Y, resulting in leakage of ink. In this exemplary embodiment, the second substrate 32 and the support member 90 are brought into contact with each other and therefore positioned to each other and, between the second substrate 32 and the support member 90, the second sealing member 80 is pressed against in the third direction Z, so that the pressure exerted on the second sealing member 80 can be appropriately adjusted. Therefore, the leakage of ink from the connecting portions between the connection flow paths 200 and the through holes 210 of the second sealing member 80 can be substantially prevented. Furthermore, in this exemplary embodiment, since the connection flow paths 200 of the second flow path member 30 and the through holes 210 of the second sealing member 80 are interconnected for communication by applying pressure thereto in the third direction Z, occurrence of an error in the positions of the connection flow paths 200 and the through holes 210 relative to each other in the first direction X and the second direction Y would unlikely result in leakage of ink. That is, each second flow path member 30 and the third flow path member 50 are positioned relative to each other in the first direction X and the second direction Y by the positioning holes 39 of the first substrate 31 and the positioning pins 94 of the support member 90. Even if the second substrate 32 deviates in position relative to the first substrate 31 in the first direction X and the second direction Y, ink leakage from the connecting portions between the connection flow paths 200 of the second flow path member 30 and the tubular flow paths 220 of the third flow path member 50, that is, the connecting portions of the through holes 210, can be substantially prevented.

Incidentally, each protruded portion 95 of the third flow path member 50 is provided with a screw hole 97 that has an opening in the first positioning surface 96. Furthermore, the bottom surface of each recess portion 43 of the second flow path members 30 is provided with a fastening hole 45 that penetrates the bottom surface in the thickness direction. Each second flow path member 30 is fixed to the third flow path member 50 by inserting screws 98 into the fastening holes 45 of the recess portions 43 of the second flow path member 30 and screwing the screws 98 into the screw holes 97 of the protruded portions 95 of the third flow path member 50 while keeping the second positioning surfaces 44 of the recess portions 43 in contact in the third direction Z with the first positioning surfaces 96 of the third flow path member 50. Thus, the screw hole 97 of each protruded portion 95 has its opening in the first positioning surface 96 of the distal end of the protruded portion 95. This means that the screw holes 97 are provided more to the connection flow path 200 side in the third direction Z than are the connecting portions between the connection flow paths 200 of the second flow path members 30 and the tubular flow paths 220 of the third flow path member 50. Because the screw holes 97 are provided more to the connection flow path 200 side than are the connecting portions between the connection flow paths 200 and the tubular flow paths 220, there is no need for a size increase for the purpose of providing spaces for the screw holes 97 and therefore a size reduction can be achieved. More specifically, when a screw hole 97 is provided, a portion surrounding the screw hole 97 needs to have a certain thickness, for example, in order to maintain a strength of the screw hole 97. If another opening, for example, a first projected portion insertion hole 92, is provided, the screw hole 97 needs to be disposed apart from that opening, leading to a size increase. In this exemplary embodiment, however, the screw holes 97 are provided in the protruded portions 95, so that a rigidity of the screw holes 97 can be maintained by the protruded portions 95 and, at the same time, a size reduction can be achieved. Furthermore, since the second flow path members 30 are fixed to the third flow path member 50 by using the screws 98, the second flow path members 30 can be easily detached from the third flow path member 50. Therefore, it is possible to replace only a second flow path member 30 and therefore improve the yield in comparison with replacement of the whole flow path member 20. Furthermore, since the second flow path members 30 can be easily detached from the third flow path member 50, a cleaning liquid can be reversely charged into the connection flow paths 200 of the second flow path members 30 so as to easily carry out the reverse washing-off of undesired matters from the connection flow paths 200 or the filters 35, or the like.

A production method for a second flow path member 30 will be described. FIGS. 9A to 9D are sectional views illustrating a production method for a second flow path member.

Figure 9A:
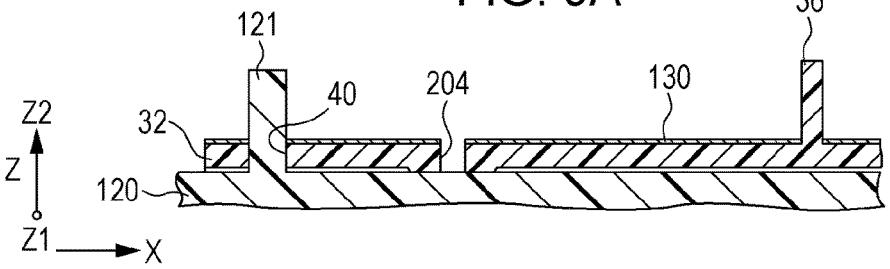
FIGS. 9A to 9D are sectional views illustrating a production method for a second flow path member.

As shown in FIG. 9A, the second substrate 32 is positioned and retained on a jig 120. The jig 120 is provided with pins 121 that is inserted into the exposure holes 40 of the second substrate 32. By inserting the pins 121 of the jig 120 into the exposure holes 40, the second substrate 32 is positioned relative to the jig 120 in the first direction X and the second direction Y. When the second substrate 32 has been positioned on the jig 120, an adhesive 130 is applied to the second substrate 32. That is, because the adhesive 130 is applied to the second substrate 32 after the second substrate 32 has been positioned and retained, the adhesive 130 can be highly accurately applied to the second substrate without applying the adhesive to an unnecessary region.

Figure 9B:
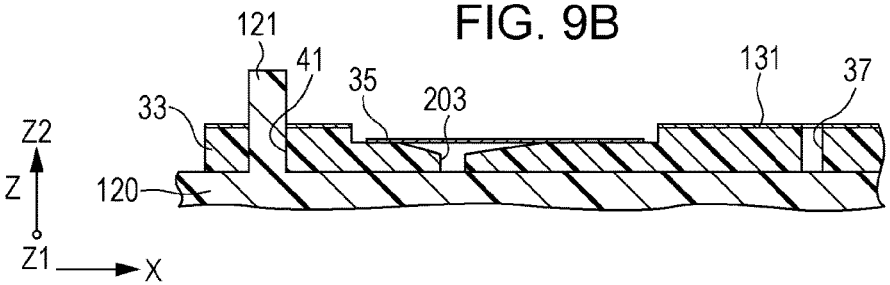

Furthermore, as shown in FIG. 9B, the intermediate substrate 33 is positioned and retained on the jig 120. This jig 120 is provided with the pins 121 insertable into the intermediate exposure holes 41 of the intermediate substrate 33. By inserting the pins 121 into the intermediate exposure holes 41, the intermediate substrate 33 is positioned relative to the jig 120 in the first direction X and the second direction Y. After the intermediate substrate is positioned relative to the jig 120 in this manner, an adhesive 131 is applied to the intermediate substrate 33. Specifically, because the adhesive 131 is applied to the intermediate substrate 33 after the intermediate substrate 33 has been positioned and retained, the adhesive 131 can be highly accurately applied to the intermediate substrate 33 without applying the adhesive 131 to an unnecessary region. Incidentally, since the intermediate substrate 33 is provided with the intermediate substrate-positioning holes 37, it is conceivable to insert the pins 121 into the intermediate substrate-positioning holes 37 in order to position the intermediate substrate 33. However, if an intermediate substrate-positioning hole 37 is used to carry out the positioning relative to the jig 120 used for retention when the adhesive 131 is applied, there is a risk of damaging or deforming the intermediate substrate-positioning hole 37 when a pin 121 is inserted into or removed from the intermediate substrate-positioning hole 37. If an intermediate substrate-positioning hole 37 is damaged or deformed, there is a risk that the positioning by inserting that intermediate substrate-positioning hole 37 over to the substrate-positioning pin 36 cannot be highly accurately carried out and a positional deviation between the first substrate 31 and the intermediate substrate 33 will occur. In this exemplary embodiment, the intermediate substrate-positioning holes 37 are not used for the positioning of the first substrate 31 and the intermediate substrate 33 relative to each other but that positioning is carried out on the jig 120 by using the intermediate exposure holes 41, which are not used to position the second flow path member 30 and the third flow path member 50 relative to each other. Therefore, even if an intermediate exposure hole 41 is damaged or deformed, there is no influence on the positioning of the first substrate 31 and the intermediate substrate 33 at the time of a stacking process or the positioning of the second flow path member and the third flow path member 50.

Figure 9C:
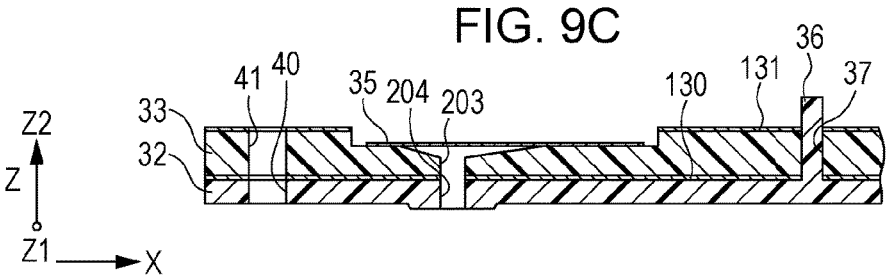

Next, as shown in FIG. 9C, the intermediate substrate 33 is stacked on the second substrate 32 and the second substrate 32 and the intermediate substrate 33 are joined via the adhesive 130.

Figure 9D:
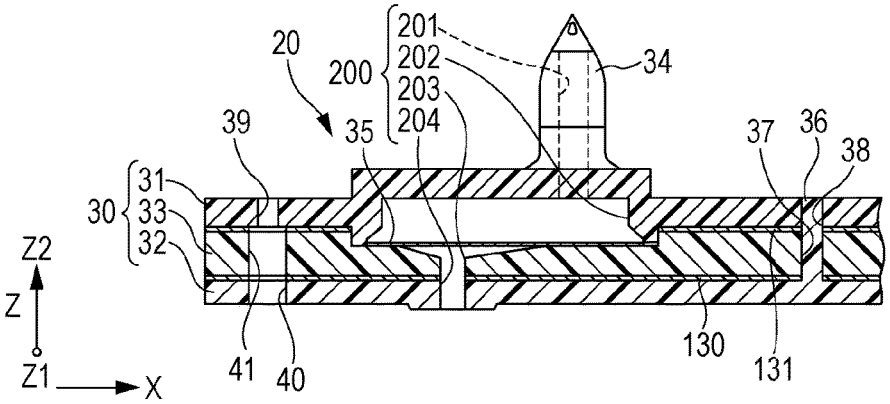

Then, as shown in FIG. 9D, the first substrate 31 is stacked on the intermediate substrate 33 and the intermediate substrate 33 and the first substrate 31 are joined via the adhesive 131. Thus, the second flow path member 30 in which the first substrate 31, the second substrate 32, and the intermediate substrate 33 have been stacked is formed.

Because the second substrate 32 and the intermediate substrate 33 are positioned on the jig 120 for applying the adhesives 130 and 131 by using the exposure holes 40 and the intermediate exposure holes 41 as positioning holes, the first substrate 31, the second substrate 32, and the intermediate substrate 33 can be highly accurately stacked without adversely affecting the positioning of the three substrates relative to each other.

Figure 10A:
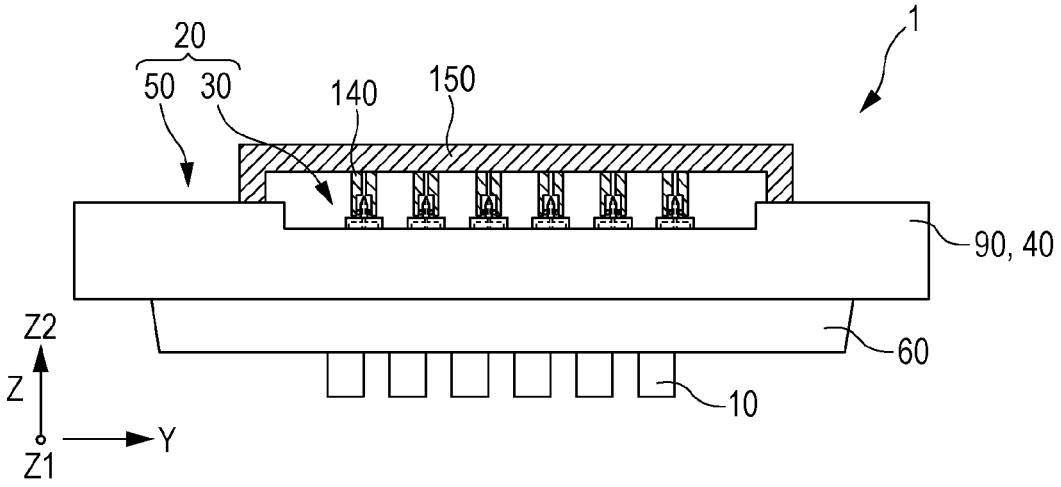
FIGS. 10A and 10B are sectional views of portions of a recording head.
Figure 10B:
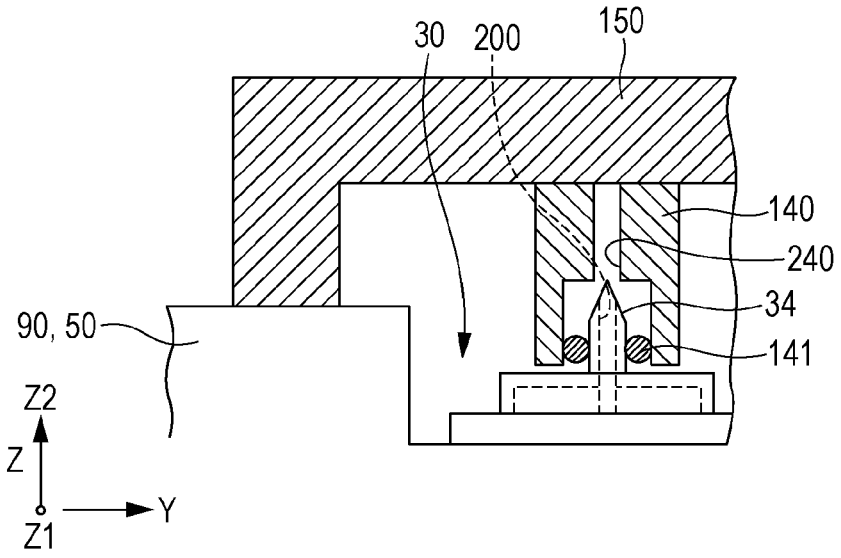

Then, a first flow path member 140 is connected to the second flow path member 30 formed as described above. An example of the first flow path member 140 will be described with reference to FIGS. 10A and 10B. FIGS. 10A and 10B are a sectional view of portions of the recording head 1 and an enlarged partial view thereof, respectively.

As shown in FIGS. 10A and 10B, first flow path members 140 are provided corresponding one-to-one to the connection portions 34 of the second flow path members 30. Specifically, in this exemplary embodiment, because the recording head 1 includes twelve connection portions 34, twelve first flow path members 140 are connected.

These first flow path members 140 are integrally retained by a retainer member 150. Then, as the retainer member 150 retaining the plurality of first flow path members 140 is fixed to the third flow path member 50, the first flow path members 140 are connected to the second flow path members 30.

Note that each first flow path member 140 has in an interior thereof a first flow path 240 as shown in FIG. 10B. A second flow path member 30-side opening portion of the first flow path 240 is provided with a first sealing member 141. The first sealing member 141 has a slightly smaller inside diameter than an outside diameter of the connection portions 34 of the second flow path members 30. By inserting the connection portions 34 into the first sealing members 141, each connection portion 34 comes into close contact with a corresponding one of the first sealing members 141, with an outer periphery of the connection portion 34 exerting pressure on an inner peripheral surface of the first sealing member 141 in the directions of normals to the inner peripheral surface, including the first direction X and the second direction Y. More specifically, the connection flow path 200 provided inside the connection portion 34 and the first flow path 240 of the first flow path member 140 are tightly sealed together, with pressure exerted in the directions orthogonal to the third direction Z, which is the stacking direction of the second flow path members 30 and the third flow path member 50, that is, in the radial directions of the connection flow path 200.

Incidentally, the first flow path members 140 are fixed while being positioned relative to the third flow path member 50 in the first direction X and the second direction Y. Concretely, in the exemplary embodiment, as the retainer member 150 retaining the first flow path members 140 is fixed to the third flow path member 50 in such a manner that the retainer member 150 is positioned relative to the third flow path member 50 in the first direction X and the second direction Y, the positioning of the first flow path members 140 relative to the third flow path member 50 in the first direction X and the second direction Y is accomplished.

Furthermore, positioning the first flow path members 140 relative to the third flow path member 50 accomplishes the positioning of the first flow path members 140 and the second flow path members 30 in the first direction X and the second direction Y. More specifically, the first substrate 31 of each second flow path member 30 has been positioned relative to the third flow path member 50 in the first direction X and the second direction Y, and the first flow path members 140 are positioned relative to the third flow path member 50 in the first direction X and the second direction Y. Thus, the first flow path members 140 and the second flow path members 30 are positioned in the first direction X and the second direction Y via the third flow path member 50. At this time, since the first sealing member 141 of each first flow path member 140 is connected to a corresponding one of the connection portions 34 provided on the first substrates 31 of each second flow path member 30 that have been positioned in the first direction X and the second direction Y, the positioning of the first sealing members 141 and the connection portions 34 in the first direction X and the second direction Y can be highly accurately carried out. Note that in a construction in which the second substrate 32 of a second flow path member 30 has been positioned relative to the third flow path member 50 in the first direction X and the second direction Y, if the second substrate 32 and the first substrate 31 provided with the connection portions 34 deviate in position, the connection portions 34 deviate in position in the direction X and the direction Y. If, in such a state, the connection portions 34 are connected to the first sealing members 141, the pressures exerted on the first sealing members 141 in the direction X and the direction Y vary, giving rise to a risk of leakage of ink. However, in this exemplary embodiment, because the first substrate 31 provided with the connection portions 34 is positioned relative to the third flow path member 50 in the first direction X and the second direction Y, the connection portions 34 can be highly accurately positioned relative to the first sealing members 141 that press the connection portions 34 in the first direction X and the second direction Y. Thus, leakage of ink can be substantially prevented. Incidentally, even if there occurs a deviation in the relative position of a connection portion 34 to the first sealing member 141 in the third direction Z, that is, the position of insertion of the connection portion 34, that deviation is not in a direction in which the connection portion 34 presses the first sealing member 141, so that ink leakage is unlikely to occur. Therefore, even if the thicknesses of the second flow path members 30 in the third direction Z vary, leakage of ink can still be substantially prevented. Furthermore, in this exemplary embodiment, the plurality of first flow path members 140 are retained integrally by the retainer member 150. Therefore, by highly accurately fixing the relative positions of the first sealing members 141 of the plurality of first flow path members 140 in the first direction X and the second direction Y and the relative positions of the plurality of connection portions 34 in the first direction X and the second direction Y, it is possible to highly accurately adjust the amounts by which the first sealing members 141 are pressed against when the plurality of first flow path members 140 are simultaneously connected to the plurality of connection portions 34. Therefore, leakage of ink can be substantially prevented. Furthermore, since the plurality of first flow path members 140 can be simultaneously connected to the plurality of connection portions 34, the operation for this connection can be simplified.

Note that the first flow path members 140 may be directly connected to a liquid storage unit, such as an ink tank in which ink is stored, or may also be connected to a liquid storage unit via a supply pipe, such as a tube, or via another flow path member or the like. Incidentally, inside each first flow path member 140 there may be provided a pressure regulation valve that opens when the downstream-side flow path has negative pressure. Furthermore, the first flow path members 140 themselves may be ink cartridges in which ink is stored, or the like.

Figure 11A:
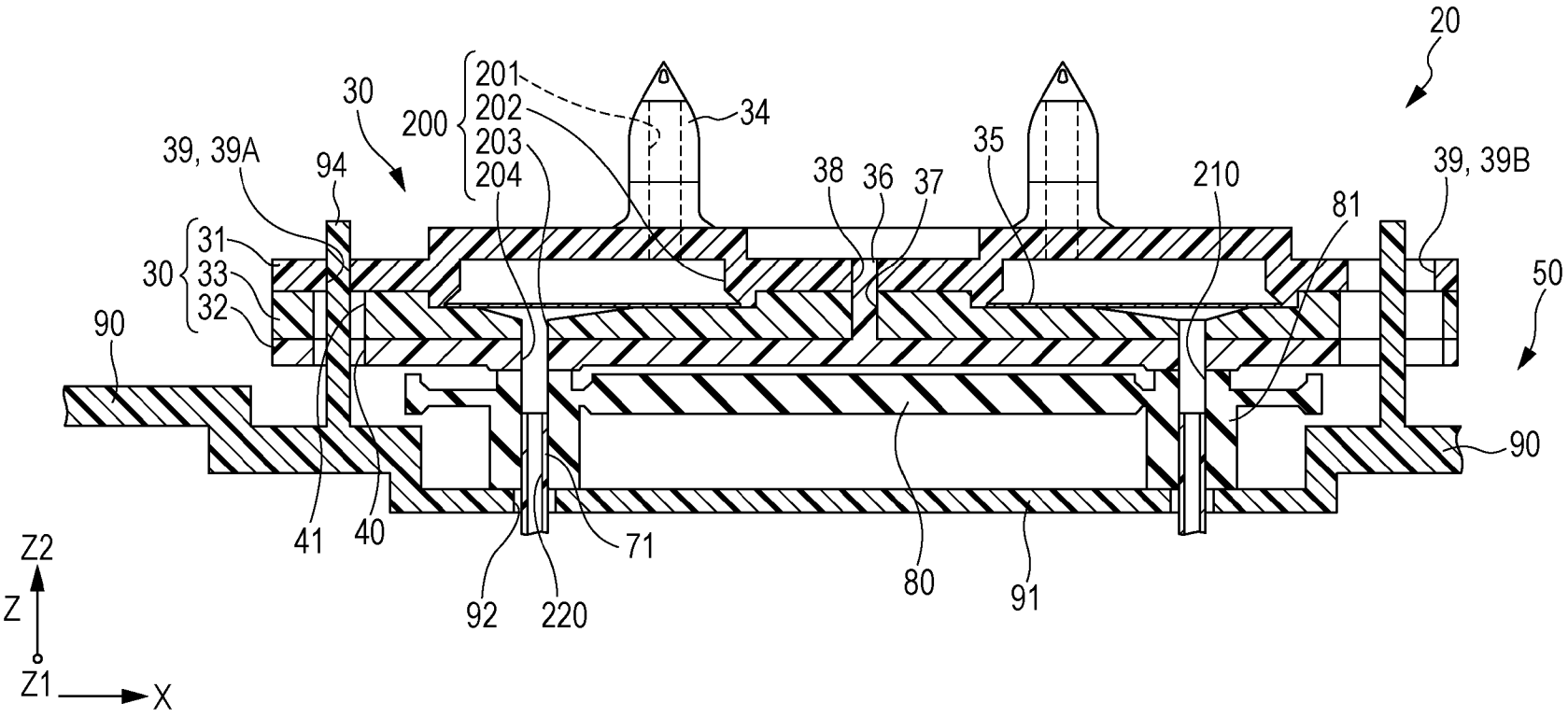
FIGS. 11A and 11B are sectional views of portions of a recording head, illustrating a production method for the recording head.
Figure 11B:
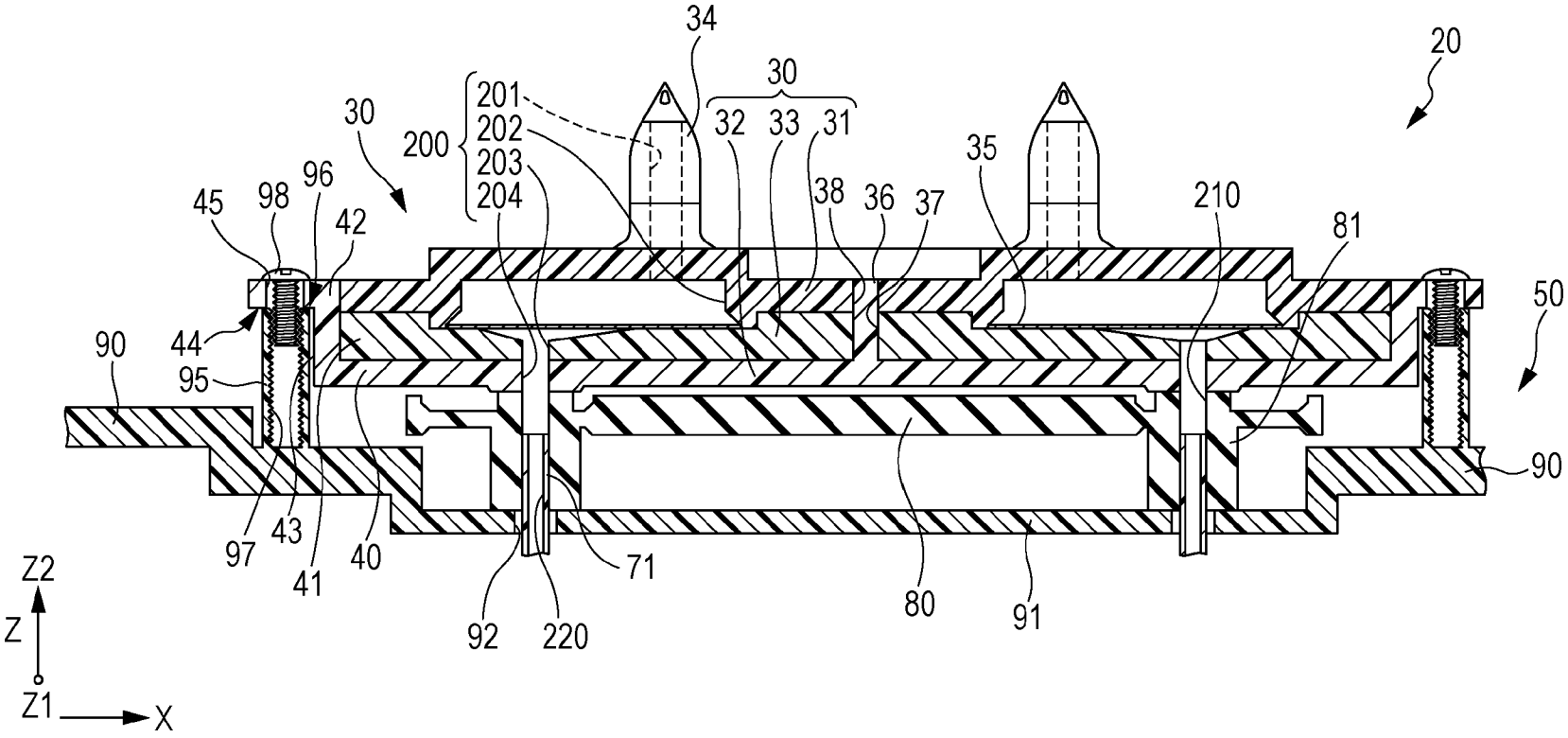
Figure 12:
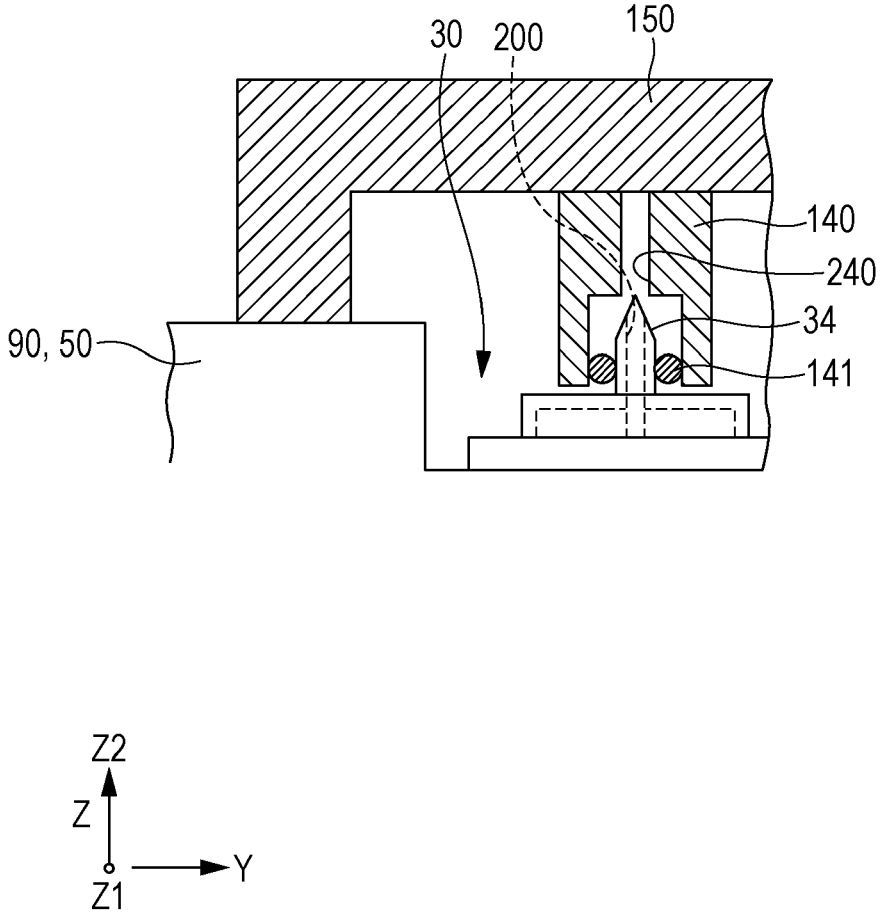
FIG. 12 is a sectional view of portions of the recording head, illustrating a production method for the recording head.

The production method for the recording head 1 of this exemplary embodiment will be further described below with reference FIGS. 11A, 11B, and 12 as well. FIGS. 11A, 11B, and 12 are sectional views of portions of the recording head, illustrating the production method for the recording head.

First, as shown in FIGS. 9A to 9D, the first substrate 31, the second substrate 32, and the intermediate substrate 33 are fixed to form a second flow path member 30 that has connection flow paths 200 (first step).

Next, as shown in FIG. 8, the holder 60, the over-the-holder member 70, the second sealing member 80, and the support member 90 are assembled to form a third flow path member 50 (second step).

Next, the second flow path member 30 is fixed to the third flow path member 50 (third step). Concretely, as shown in FIG. 11A, the positioning pins 94 of the third flow path member 50 are inserted into the positioning holes 39 of the second flow path member 30 to position the second flow path member 30 relative to the third flow path member 50 in the first direction X and the second direction Y.

Next, as shown in FIG. 11B, the first positioning surface 96 of each protruded portion 95 of the third flow path member 50 is placed in contact with a corresponding one of the second positioning surfaces 44 of the second flow path member 30 to position the second flow path member 30 relative to the third flow path member 50 in the third direction Z. Furthermore, the screws 98 are screwed into the screw holes 97 of the protruded portions 95 to fix the second flow path member 30 to the third flow path member 50.

Subsequently, as shown in FIG. 12, the connection portions 34 of the second flow path member 30 are pushed into the first sealing members 141 of the first flow path members 140 so that pressure force is exerted on the first sealing members 141 in the first direction X and the second direction Y, whereby the connection flow paths 200 and the first flow paths 240 are connected (fourth step).

Thus, the amounts of press of each first sealing member 141 in the first direction X and the second direction Y can be highly accurately adjusted and the amount of press of the second sealing member 80 in the third direction Z can be highly accurately adjusted. Therefore, the ink leakage from the connecting portions between the first flow paths 240 that are the first flow paths of the first flow path members 140 and the connection flow paths 200 that are the second flow paths of the second flow path members 30 can be substantially prevented. Furthermore, the ink leakage from the connecting portions between the connection flow paths 200 of the second flow path members 30 and the tubular flow paths 220 that are the third flow paths of the third flow path member 50 can be substantially prevented.

Other Exemplary Embodiments

While an exemplary embodiment of the invention has been described above, a basic configuration of the invention is not limited to what have been described above.

For example, although, in Example Embodiment 1 described above, the first substrate 31 is provided with the positioning holes 39, the third flow path member 50 is provided with the positioning pins 94, and the positioning pins 94 of the third flow path member 50 and the positioning holes 39 of the first substrate 31 are positioned to each other in the first direction X and the second direction Y, this does not particularly restrict the invention. For example, the first substrate 31 may be provided with positioning pins and the third flow path member 50 may be provided with positioning holes into which the positioning pins are inserted. In this configuration, too, the first substrate 31 can be highly accurately positioned relative to the third flow path member 50 in the first direction X and the second direction Y.

Furthermore, in Exemplary Embodiment 1, the first sealing members 141 that tightly seal the connecting portions between the first flow paths 240 of the first flow path members 140 and the connection flow paths 200 of the second flow path members 30 are pressed against in the first direction X and the second direction Y and the second sealing members 80 that tightly seal the connecting portions between the connection flow paths 200 of the second flow path members 30 and the tubular flow paths 220 of the third flow path member 50 are pressed against in the third direction Z. However, this does restrict the invention. For example, the first sealing members 141 that tightly seal the connecting portions between the first flow paths 240 of the first flow path members 140 and the connection flow paths 200 of the second flow path members 30 may be pressed in the third direction Z and the second sealing members 80 that tightly seal the connecting portions between the connection flow paths 200 of the second flow path members 30 and the tubular flow paths 220 of the third flow path member 50 may be pressed in the first direction X and the second direction Y. In this configuration, it suffices that the first substrate 31 in each second flow path member 30 is stacked at the Z1 side of the second substrate 32. Incidentally, although the connecting portions between the connection flow paths 200 of the second flow path members 30 and the through holes 210 of the second sealing members 80 are hidden by the support members 90 and the like, the positioning of the second substrate 32 of each second flow path member 30 to the third flow path member 50 in the first direction X and the second direction Y will make it possible to certainly interconnect the connection flow paths 200 of the second flow path members 30 and the through holes 210 of the second sealing members 80, without a need to visually check the connecting process, and therefore substantially prevent leakage of ink. Furthermore, although in Exemplary Embodiment 1, ink flows from the first flow path members 140 into the third flow path member 50 through the second flow path members 30, this does not particularly restrict the invention. For example, it is also permissible to provide a configuration such that ink flows from the third flow path member 50 side to the first flow path member 140 side through the second flow path members 30.

Furthermore, although in Exemplary Embodiment 1, the stacking direction of the second flow path members 30 and the third flow path member 50 is the third direction Z and the first direction X, the second direction Y, and the third direction Z are orthogonal to each other, this does not restrict the invention. As long as the first direction X and the second direction Y are orthogonal to each other, the first and second directions X and Y may intersect with the third direction Z at angles other than 90 degrees.

Further, although in Exemplary Embodiment 1, the second flow path members 30 are fixed to the third flow path member 50 by screws 98, this does not particularly restrict the invention. The second flow path members 30 may also be fixed to the third flow path member 50 by clamps or the like. Note that if the second flow path members 30 are detachably fixed to the third flow path member 50, the connection flow paths 200 of the second flow path members 30 can easily be subjected to reverse washing.

Still further, although in Exemplary Embodiment 1, the second flow path members 30 are provided with the filters 35, there is not a requirement that the second flow path members 30 be provided with the filter 35, that is, the second flow path members 30 may be provided without the filters 35. The filters 35 may be provided, for example, in the third flow path member 50.

Furthermore, although each second flow path member 30 is provided with the exposure holes 40 and the intermediate exposure holes 41, this does not particularly restrict the invention. The exposure holes 40 and the intermediate exposure holes 41 do not need to be provided. Even when neither the exposure holes 40 nor the intermediate exposure holes 41 are provided, it suffices that the positioning holes 39 are exposed when viewed from the Z1 side in the third direction Z.

Furthermore, although Exemplary Embodiment 1 is described above in conjunction with an exemplary configuration in which the first substrate 31, the second substrate 32, and the intermediate substrate 33 in each second flow path member 30 are positioned relative to each other in the first direction X and the second direction Y by the substrate-positioning pins 36, the intermediate substrate-positioning holes 37, and the substrate-positioning holes 38, this does not particularly restrict the invention. For example, the first substrate 31, the second substrate 32, and the intermediate substrate 33 may be provided with marks and positioned to each other by visually checking the marks. Furthermore, the positioning of these substrates may be accomplished with reference to the external shapes of these substrates and may also be accomplished by utilizing image processing.

Figure 13:
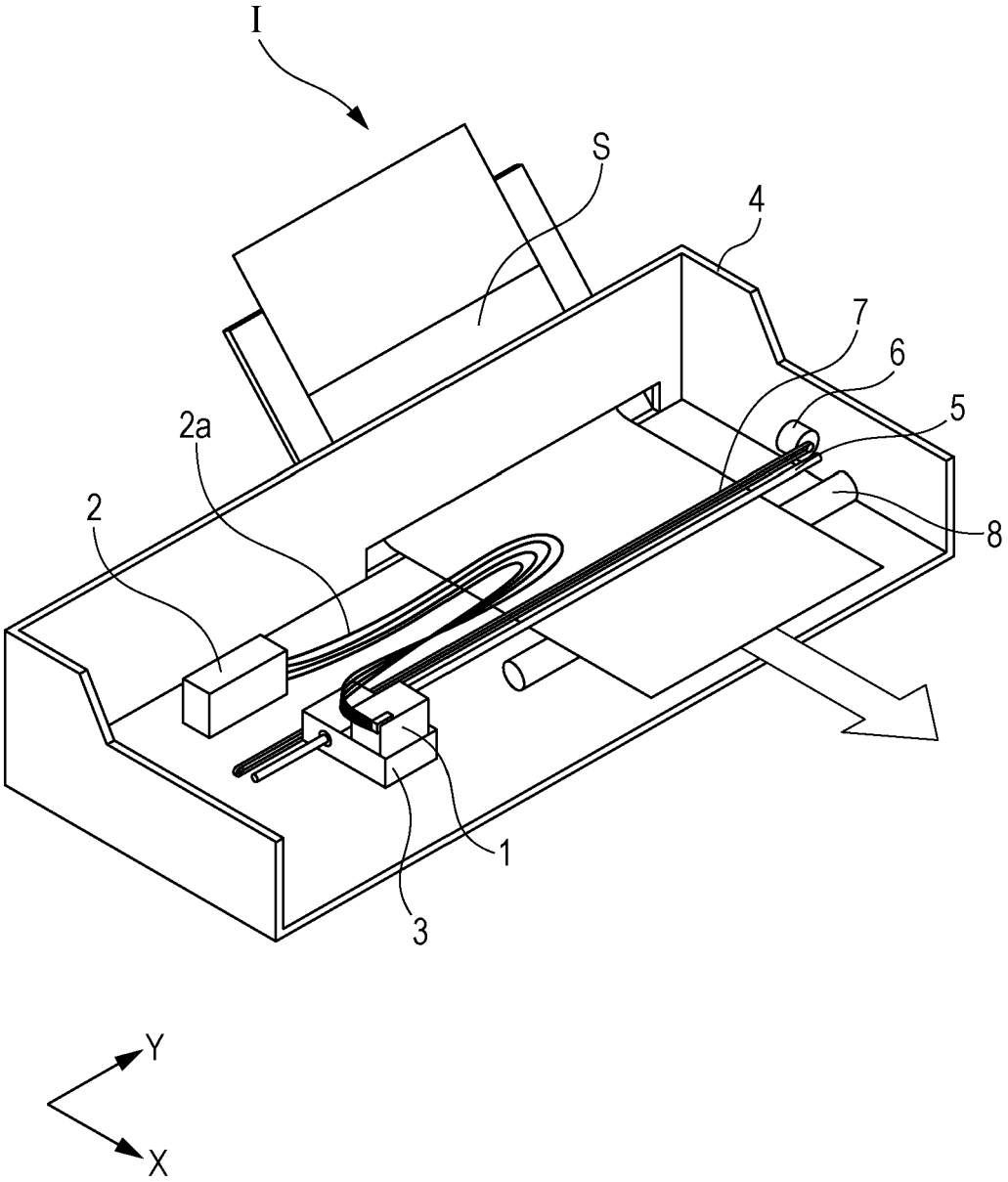
FIG. 13 is a schematic diagram of a recording apparatus.

The recording head 1 according to the foregoing exemplary embodiments is mounted in an ink jet recording apparatus. FIG. 13 is a schematic diagram illustrating an example of such an ink jet recording apparatus.

In an ink jet recording apparatus I shown in FIG. 13, the recording head 1 is connected to a liquid storage unit 2, such as an ink tank, via a supply pipe 2*a* such as a tube. The recording head 1 is mounted on a carriage 3. The carriage 3 is provided on a carriage shaft 5 attached to an apparatus main body 4 so that the carriage 3 is movable in the directions of the axis of the carriage shaft 5. In this exemplary embodiment, the recording head 1 is disposed so that the second direction Y of the recording head 1 coincides with the moving directions of the carriage 3.

As drive force of a driving motor 6 is transmitted to the carriage 3 via a plurality of gears (not shown) and a timing belt 7, the carriage 3 on which the recording head 1 is mounted is moved along the carriage shaft 5. The apparatus main body 4 is provided with a transport roller 8 as a transport unit so that a recording sheet S that is a recording medium, such as paper, is transported by the transport roller 8. Incidentally, the transport unit that transports a recording sheet S is not limited to the transport roller but may also be a belt, a drum, etc.

Although in the foregoing ink jet recording apparatus I, the recording head 1 is mounted on the carriage 3 and thereby moved in the main scanning directions, this configuration does not particularly restrict the invention. The invention is also applicable to, for example, a so-called line type recording apparatus in which the recording head 1 is stationary and only a recording sheet S, such as paper, is moved in the subsidiary scanning direction to perform printing.

Furthermore, although the exemplary embodiments have been described above in conjunction with the ink jet recording head as an example of a liquid ejecting head and with the ink jet recording apparatus as an example of a liquid ejecting apparatus, the invention is intended widely for liquid ejecting heads and liquid ejecting apparatuses in general and is of course applicable also to liquid ejecting heads and liquid ejecting apparatuses that eject liquids other than ink. Examples of such liquid ejecting heads include various recording heads for use in image recording apparatuses, such as printers, color material ejecting heads for use in producing color filters for liquid crystal displays and the like, electrode material ejecting heads for use in forming electrodes for organic electroluminescent (EL) displays, field emission displays (FEDs), etc., bioorganic material ejecting heads for use in producing biochips, etc. The invention is also applicable to the liquid ejecting apparatuses equipped with such liquid ejecting heads.

What is claimed is:

1. A liquid ejecting head comprising:

a second flow path member that has a second flow path in communication with a first and a third flow paths provided in a first flow path member and a third flow path member, the second flow path member stacked with the third flow path member in a stacking direction; and a nozzle configured to eject a liquid supplied via the first flow path, the second flow path, and the third flow path, wherein a boundary between the first flow path and the second flow path is tightly sealed by a first sealing member, and wherein a boundary between the second flow path and the third flow path is tightly sealed by a second sealing member, and wherein the second flow path member includes a first substrate for positioning itself to the third flow path member in a first direction and a second direction intersecting with the stacking direction, and a second substrate for positioning itself to the third flow path member in the stacking direction, and wherein the first substrate is pressed against in the first direction and the second direction by one of the first sealing member and the second sealing member, and wherein the second substrate is pressed against in the stacking direction by another one of the first sealing member and the second sealing member.

2. The liquid ejecting head according to claim 1, wherein:

the second flow path member is fixed to the third flow path member by a screw that is screwed to a screw hole that is provided in the third flow path member; and the screw hole is provided more to a second flow path side in the stacking direction than is the boundary between the second flow path and the third flow path.

3. A liquid ejecting apparatus comprising the liquid ejecting head according claim 2.

4. The liquid ejecting head according to claim 1, wherein the second flow path member has a filter between the first substrate and the second substrate.

5. A liquid ejecting apparatus comprising the liquid ejecting head according claim 4.

6. The liquid ejecting head according to claim 1, wherein:

the third flow path member includes a positioning pin that is used for positioning in the first direction and the second direction and a first positioning surface that is used for positioning in the stacking direction;

the first substrate includes a positioning hole that contacts the positioning pin of the third flow path member in the first direction and the second direction; and the second substrate includes a second positioning surface that contacts the first positioning surface of the third flow path member in the stacking direction.

7. The liquid ejecting head according to claim 6, wherein the second substrate includes an exposure hole that exposes the positioning hole of the first substrate when viewed in the stacking direction from a proximal end side of the positioning pin to a distal end side of the positioning pin.

8. A liquid ejecting apparatus comprising the liquid ejecting head according to claim 6.

9. The liquid ejecting head according to claim 1, wherein:

one of the first substrate and the second substrate includes a substrate-positioning pin that carries out positioning of the first substrate and the second substrate relative to each other in the first direction and the second direction; and another one of the first substrate and the second substrate includes a substrate-positioning hole that contacts the substrate-positioning pin in the first direction and the second direction.

10. The liquid ejecting head according to claim 1, wherein the first substrate and the second substrate are provided with the second flow path.

11. A liquid ejecting apparatus comprising the liquid ejecting head according to claim 1.

12. A flow path member that provides communication between a first flow path provided in a first flow path member and a third flow path provided in a third flow path member by using a first sealing member and a second sealing member and that is stacked with the third flow path member in a stacking direction, the flow path member comprising:

a first substrate for positioning itself to the third flow path member in a first direction and a second direction that intersect with the stacking direction;

a second substrate for positioning itself to the third flow path member in the stacking direction; and a second flow path for communicating with the first flow path in a state of being tightly sealed by the first sealing member and for communicating with the third flow path in a state of being tightly sealed by the second sealing member, wherein the first substrate is pressed against in the first direction and the second direction by one of the first sealing member and the second sealing member, and wherein the second substrate is pressed against in the stacking direction by another one of the first sealing member and the second sealing member.

13. The flow path member according to claim 12, which is fixed to the third flow path member by a screw that is screwed to a screw hole that is provided in the third flow path member, wherein the screw hole is provided more to a second flow path side in the stacking direction than is the boundary between the second flow path and the third flow path.

14. The flow path member according to claim 12, which has a filter between the first substrate and the second substrate.

15. The flow path member according to claim 12, wherein:

the third flow path member includes a positioning pin that is used for the positioning in the first direction and the second direction and a first positioning surface that is used for the positioning in the stacking direction;

the first substrate includes a positioning hole that contacts the positioning pin of the third flow path member in the first direction and the second direction; and the second substrate includes a second positioning surface that contacts the first positioning surface of the third flow path member in the stacking direction.

16. The flow path member according to claim 15, wherein the second substrate includes an exposure hole that exposes the positioning hole of the first substrate when viewed in the stacking direction from a proximal end side of the positioning pin to a distal end side of the positioning pin.

17. The flow path member according to claim 12, wherein:

one of the first substrate and the second substrate includes a substrate-positioning pin that carries out positioning of the first substrate and the second substrate relative to each other in the first direction and the second direction; and another one of the first substrate and the second substrate includes a substrate-positioning hole that contacts the substrate-positioning pin in the first direction and the second direction.

18. The flow path member according to claim 12, wherein the first substrate and the second substrate are provided with the second flow path.

19. A production method for a liquid ejecting head that includes:

a second flow path member that includes a second flow path that communicates with a first flow path provided in a first flow path member;

a third flow path member that includes a third flow path that communicates with the second flow path of the second flow path member; and a nozzle that ejects a liquid supplied via the first flow path, the second flow path, and the third flow path, the production method comprising:

fixing a first substrate and a second substrate and forming the second flow path of the second flow path member;

fixing a second sealing member to the third flow path member;

tightly sealing a boundary between the second flow path and the third flow path by the second sealing member in a state in which the second sealing member is pressed against in the stacking direction by the second substrate and the third flow path member, carrying out positioning relative to the third flow path member in the stacking direction through use of the second substrate, and carrying out positioning relative to the third flow path member in a first direction and a second direction that intersect with the stacking direction through use of the first substrate; and tightly sealing a boundary between the first flow path and the second flow path by the first sealing member in a state in which the first sealing member is pressed against in the first direction and the second direction by the first flow path member and the first substrate.

* * * * *